US011724152B2

(12) United States Patent
French et al.

(10) Patent No.: US 11,724,152 B2
(45) **Date of Patent: *Aug. 15, 2023**

(54) STATIONARY EXERCISE MACHINE WITH FOUR-BAR LINKAGE TRANSMISSION

(71) Applicant: NAUTILUS, INC., Vancouver, WA (US)

(72) Inventors: Edana French, Portland, OR (US); Kirk Tedsen, Brush Prairie, WA (US); Bryan W. Hamilton, Vancouver, WA (US)

(73) Assignee: NAUTILUS, INC., Vancouver, WA (US)

( * ) Notice: Subject to any disclaimer, the term of this patent is extended or adjusted under 35 U.S.C. 154(b) by 10 days.

This patent is subject to a terminal disclaimer.

(21) Appl. No.: 17/328,954

(22) Filed: May 24, 2021

(65) Prior Publication Data

US 2021/0275859 A1 Sep. 9, 2021

Related U.S. Application Data

(63) Continuation of application No. 16/517,415, filed on Jul. 19, 2019, now Pat. No. 11,013,952.

(Continued)

(51) Int. Cl.
*A63B 22/00* (2006.01)
*A63B 21/22* (2006.01)

(52) U.S. Cl.
CPC ..... *A63B 22/0076* (2013.01); *A63B 21/225* (2013.01); *A63B 22/0087* (2013.01); *A63B 2022/0084* (2013.01)

(58) Field of Classification Search
CPC .... A63B 2022/0035; A63B 2022/0041; A63B 2022/0079; A63B 2022/0082;

(Continued)

(56) References Cited

U.S. PATENT DOCUMENTS 3,898,950 A 8/1975 Martin
4,284,272 A 8/1981 Evans et al.

(Continued)

FOREIGN PATENT DOCUMENTS

CN 201603338 U 10/2010
CN 202185108 U 4/2012

(Continued)

OTHER PUBLICATIONS

International Search Report and Written Opinion for PCT/US2019/042682 dated Jan. 31, 2020.

(Continued)

*Primary Examiner* — Andrew S Lo
*Assistant Examiner* — Andrew M Kobylarz
(74) *Attorney, Agent, or Firm* — Dorsey & Whitney LLP

(57) ABSTRACT

A rowing machine is disclosed. The rowing machine includes a frame including a base for contact with a support surface and a seat rail supported by the base. The rowing machine includes a seat configured to reciprocate back and forth along the seat rail. The rowing machine includes a rowing engine that includes at least one resistance mechanism rotatably coupled to the frame. The rowing machine includes at least one handle operatively connected to the at least one resistance mechanism, and a paddle linkage assembly operatively connecting the at least one handle to the at least one resistance mechanism such that rearward movement of the handle is resisted by the at least one resistance mechanism.

19 Claims, 18 Drawing Sheets

Related U.S. Application Data

(60) Provisional application No. 62/701,391, filed on Jul. 20, 2018.

(58) Field of Classification Search
CPC .... A63B 2022/0094; A63B 2022/0097; A63B 21/00058; A63B 21/00061; A63B 21/00065; A63B 21/00076; A63B 21/00178; A63B 21/062; A63B 21/15; A63B 21/159; A63B 21/22; A63B 21/222; A63B 21/225; A63B 21/4023; A63B 21/4027; A63B 21/4033; A63B 21/4035; A63B 21/4045; A63B 21/4047; A63B 21/4049; A63B 22/00; A63B 22/0007; A63B 22/001; A63B 22/0015; A63B 22/0017; A63B 22/0025; A63B 22/0048; A63B 22/0076; A63B 22/0087; A63B 22/20; A63B 23/00; A63B 23/0222; A63B 23/035; A63B 23/03508; A63B 23/12
See application file for complete search history.

(56) References Cited

U.S. PATENT DOCUMENTS 4,346,886 A 8/1982 Cox et al.
4,396,188 A 8/1983 Dreissigacker et al.
4,421,307 A 12/1983 Cunnington et al.
4,477,071 A 10/1984 Brown et al.
4,541,627 A 9/1985 MacLean et al.
4,563,000 A 1/1986 Gall
4,572,500 A 2/1986 Weiss
D286,311 S 10/1986 Martinell et al.
4,647,035 A 3/1987 Yellen
4,650,181 A 3/1987 Yang
4,674,741 A 6/1987 Pasierb, Jr. et al.
4,690,398 A 9/1987 Smith
4,695,050 A 9/1987 Smith et al.
4,705,493 A 11/1987 Lin
4,714,244 A 12/1987 Kolomayets et al.
4,722,520 A 2/1988 Lee
4,723,774 A 2/1988 Monforte
4,735,410 A 4/1988 Nobuta
4,736,944 A 4/1988 Johnson et al.
4,743,010 A 5/1988 Geraci
4,743,011 A * 5/1988 Coffey ..... A63B 21/0088 482/73
4,746,112 A * 5/1988 Fayal ..... A63B 21/153 482/73
4,756,523 A * 7/1988 Rasmussen ..... A63B 22/0076 482/73
4,768,775 A * 9/1988 Marshall ..... A63B 22/0076 482/133
4,768,776 A * 9/1988 Giannotti ..... A63B 22/203 482/73
4,772,013 A * 9/1988 Tarlow, Jr. ..... A63B 22/0076 482/901
4,795,147 A * 1/1989 Seal ..... A63B 21/4047 482/73
4,798,378 A * 1/1989 Jones ..... A63B 22/0076 482/72
4,813,667 A 3/1989 Watterson
4,822,032 A * 4/1989 Whitmore ..... A63B 22/0012 482/72
4,846,460 A * 7/1989 Duke ..... A63B 22/0076 482/73
4,867,447 A * 9/1989 Johnson ..... A63B 22/0076 482/901
4,880,224 A * 11/1989 Jonas ..... A63B 21/225 482/72
4,883,268 A 11/1989 Salkind
4,884,800 A 12/1989 Duke
4,921,242 A 5/1990 Watterson
4,930,769 A 6/1990 Nenoff
4,943,051 A 7/1990 Haskins et al.
4,974,832 A 12/1990 Dalebout
4,976,423 A 12/1990 Routti
4,997,181 A 3/1991 Lo
5,013,033 A 5/1991 Watterson et al.
5,072,929 A 12/1991 Peterson et al.
5,092,581 A 3/1992 Koz
5,094,446 A 3/1992 Wiedner
5,104,363 A 4/1992 Shi
5,108,093 A 4/1992 Watterson
5,122,105 A 6/1992 Engel et al.
D337,799 S 7/1993 Cutter et al.
5,295,931 A 3/1994 Dreibelbis et al.
D352,534 S 11/1994 Dreibelbis et al.
5,370,593 A 12/1994 Wang
5,382,210 A 1/1995 Rekers
5,441,469 A 8/1995 Chern
D367,508 S 2/1996 Dreissigacker et al.
5,569,130 A 10/1996 Wang
5,616,105 A 4/1997 Wang et al.
5,645,514 A 7/1997 Chen
5,658,225 A 8/1997 Huang
5,707,322 A 1/1998 Dreissigacker et al.
5,779,600 A * 7/1998 Pape ..... A63B 23/03533 482/73
5,865,713 A 2/1999 Hsu
5,899,780 A 5/1999 Robbins
5,916,069 A 6/1999 Wang et al.
6,071,215 A 6/2000 Raffo et al.
6,168,554 B1 1/2001 Berg et al.
6,206,808 B1 3/2001 Ho
6,231,485 B1 5/2001 Dreissigacker et al.
6,371,892 B1 4/2002 Dreissigacker et al.
6,527,680 B1 3/2003 Maresh
6,561,955 B1 5/2003 Dreissigacker et al.
6,565,489 B2 5/2003 Ho et al.
6,602,168 B2 8/2003 Duke
6,682,462 B1 1/2004 Lee
6,695,753 B2 2/2004 Ho et al.
6,749,546 B2 6/2004 Yang
6,926,647 B1 8/2005 Huang et al.
6,960,156 B2 11/2005 Smith
6,981,932 B1 1/2006 Huang et al.
6,991,589 B1 1/2006 Patterson
7,022,052 B1 4/2006 Lai
7,108,639 B2 9/2006 Smith et al.
7,115,077 B2 10/2006 Yang
7,141,008 B2 11/2006 Krull et al.
7,201,708 B2 4/2007 Dreissigacker et al.
7,204,790 B2 4/2007 Sleamaker
7,226,397 B1 6/2007 MacDonald et al.
7,229,388 B2 6/2007 Yang
7,270,630 B1 9/2007 Patterson
7,361,124 B1 4/2008 Chung-Ting
7,381,164 B2 6/2008 Smith et al.
7,500,938 B2 3/2009 Fan
7,572,211 B2 8/2009 Roach
7,585,263 B2 9/2009 Brown et al.
7,708,670 B2 5/2010 Bowser
7,731,637 B2 6/2010 D'Eredita
7,766,802 B2 8/2010 Webber et al.
7,815,552 B2 10/2010 Dibble et al.
7,833,136 B2 * 11/2010 Bell ..... A63B 22/0076 482/138
7,846,074 B2 * 12/2010 Wu ..... A63B 21/155 482/92
7,862,484 B1 * 1/2011 Coffey ..... A63B 21/157 482/72
7,946,964 B2 5/2011 Gothro et al.
7,988,601 B2 8/2011 Bowser
8,038,582 B2 10/2011 Edmonson
8,070,657 B2 12/2011 Loach
8,192,332 B2 6/2012 Baker et al.
8,235,874 B2 8/2012 D'Eredita
8,608,626 B2 * 12/2013 Campbell ..... A63B 21/05 482/72
8,622,876 B2 1/2014 Kelliher
8,771,151 B2 7/2014 Larsson

(56) References Cited

U.S. PATENT DOCUMENTS

| | | | | |
|---|---|---|---|---|
| 8,795,210 | B2 * | 8/2014 | Talish | A43B 1/0054 601/78 |
| 8,944,969 | B2 | 2/2015 | Giannelli | |
| 9,005,086 | B1 | 4/2015 | O'Neil | |
| 9,028,374 | B1 | 5/2015 | Brady | |
| 9,272,180 | B2 * | 3/2016 | Eschenbach | A63B 22/0056 |
| 9,750,972 | B1 | 9/2017 | Liu et al. | |
| 9,770,622 | B2 | 9/2017 | Campanaro et al. | |
| 10,376,730 | B2 * | 8/2019 | Cei | A63B 21/0056 |
| 10,449,409 | B2 * | 10/2019 | Hamilton | A63B 21/0051 |
| 11,013,952 | B2 * | 5/2021 | French | A63B 21/159 |
| 11,298,584 | B2 * | 4/2022 | Wamser | A63B 22/0076 |
| 2001/0008861 | A1 * | 7/2001 | Dreissigacker | A63B 21/0088 482/111 |
| 2002/0022558 | A1 * | 2/2002 | Casey | A63B 21/4035 482/96 |
| 2002/0115537 | A1 * | 8/2002 | Lin | A63B 22/0076 482/72 |
| 2003/0166438 | A1 * | 9/2003 | Gramaccioni | A63B 26/003 482/72 |
| 2005/0101450 | A1 | 5/2005 | Gramaccioni | |
| 2005/0130810 | A1 * | 6/2005 | Sands | A63B 21/0552 482/72 |
| 2005/0272568 | A1 * | 12/2005 | Wang | A63B 22/0076 482/72 |
| 2005/0277521 | A1 * | 12/2005 | Lat | A63B 22/0076 482/72 |
| 2006/0009334 | A1 | 1/2006 | Smith et al. | |
| 2006/0100069 | A1 * | 5/2006 | Dibble | A63B 23/03525 482/100 |
| 2006/0116249 | A1 | 6/2006 | Dibble et al. | |
| 2006/0264128 | A1 * | 11/2006 | Osten | B63H 16/102 440/102 |
| 2006/0270528 | A1 * | 11/2006 | Lai | A63B 23/0222 482/72 |
| 2007/0049470 | A1 * | 3/2007 | Pyles | A63B 22/0023 482/95 |
| 2007/0082793 | A1 * | 4/2007 | Yang | A63B 21/0552 482/72 |
| 2007/0191189 | A1 * | 8/2007 | Hsu | A63B 22/0056 482/53 |
| 2008/0261782 | A1 * | 10/2008 | Campbell | A63B 22/0076 482/72 |
| 2010/0009816 | A1 * | 1/2010 | Edmondson | A63B 22/0076 482/72 |
| 2011/0028278 | A1 * | 2/2011 | Roach | A63B 22/0076 482/72 |
| 2011/0065554 | A1 | 3/2011 | Van Straaten | |
| 2011/0082015 | A1 * | 4/2011 | Dreissigacker | A63B 21/00069 482/72 |
| 2012/0065034 | A1 | 3/2012 | Loach | |
| 2012/0100965 | A1 * | 4/2012 | Dreissigacker | A63B 22/0005 482/72 |
| 2012/0225753 | A1 | 9/2012 | Lim | |
| 2013/0130206 | A1 * | 5/2013 | Smith | A63B 24/0006 434/29 |
| 2013/0296137 | A1 | 11/2013 | Liang et al. | |
| 2014/0243163 | A1 | 4/2014 | Edmondson | |
| 2014/0141941 | A1 * | 5/2014 | Giannelli | A63B 21/4047 482/72 |
| 2014/0336011 | A1 * | 11/2014 | Singh | A63B 22/0076 482/72 |
| 2015/0202484 | A1 | 7/2015 | Lalaoua | |
| 2015/0258366 | A1 | 9/2015 | Domeika et al. | |
| 2016/0001123 | A1 | 1/2016 | Parrish, Jr. | |
| 2016/0059069 | A1 | 3/2016 | Jeremie et al. | |
| 2016/0144223 | A1 | 5/2016 | Dalebout et al. | |
| 2016/0287933 | A1 * | 10/2016 | Lin | A63B 22/001 |
| 2016/0375297 | A1 | 12/2016 | Kiser | |
| 2017/0043208 | A1 | 2/2017 | Lonergan | |
| 2017/0319889 | A1 | 11/2017 | Cei et al. | |
| 2018/0056117 | A1 * | 3/2018 | Hamilton | A63B 69/06 |
| 2020/0023232 | A1 | 1/2020 | French et al. | |
| 2022/0177303 | A1 * | 6/2022 | Thompson | B82B 1/005 |

FOREIGN PATENT DOCUMENTS

| | | | |
|---|---|---|---|
| CN | 205494791 | U | 8/2016 |
| CN | 106730595 | A | 5/2017 |
| CN | 206372491 | U | 8/2017 |
| CN | 207384713 | U | 5/2018 |
| CN | 207605300 | U | 7/2018 |
| DE | 3625159 | A1 | 2/1987 |
| DE | 3943391 | A1 | 8/1990 |
| EP | 2545965 | A2 | 1/2013 |
| ES | 1187316 | U | 7/2017 |
| GB | 1101009 | A | 1/1968 |
| GB | 2327621 | A | 2/1999 |
| GB | 2380331 | A | 4/2003 |
| IT | 20110188 | A1 | 3/2013 |
| WO | 8002647 | A1 | 12/1980 |
| WO | 8704358 | A1 | 7/1987 |
| WO | 9014132 | A1 | 11/1990 |
| WO | 9722389 | A1 | 6/1997 |
| WO | 0076592 | A1 | 12/2000 |
| WO | 2005025685 | A1 | 3/2005 |
| WO | 2008137841 | A1 | 11/2008 |
| WO | 2009097452 | A1 | 8/2009 |
| WO | 2011056210 | A1 | 5/2011 |
| WO | 2013006145 | A1 | 1/2013 |
| WO | 2014054931 | A1 | 4/2014 |
| WO | 2014179866 | A1 | 11/2014 |
| WO | 2014196870 | A1 | 12/2014 |
| WO | 2015054618 | A1 | 4/2015 |

OTHER PUBLICATIONS

"Translation for Second Office Action for CN 201980059018.X, dated Apr. 19, 2022".

English translation of First Office Action for CN Appl. No. 201980059018.X dated Oct. 11, 2021.

* cited by examiner

STATIONARY EXERCISE MACHINE WITH FOUR-BAR LINKAGE TRANSMISSION

CROSS-REFERENCE TO RELATED APPLICATIONS

This application is a continuation of U.S. application Ser. No. 16/517,415 filed Jul. 19, 2019, issued as U.S. Pat. No. 11,013,962 on May 25, 2021, which claims the benefit of priority pursuant to 35 U.S.C. § 119(e) of U.S. provisional patent application No. 62/701,391, filed Jul. 20, 2018, entitled "ROWING MACHINE," which are hereby incorporated by reference herein in their entirety.

BACKGROUND

An indoor rower, or rowing machine, is a machine used to simulate the action of watercraft rowing for the purpose of exercise or training for rowing. On a conventional rower, the user pulls a bar connected to a chain which is attached to a drive mechanism typically with adjustable resistance. The bar to chain configuration of conventional rowers results generally in only forward and backward motion, which may not fully mimic the action of watercraft rowing. Designers and manufacturers of rowing machines therefore continue to seek improvements thereto.

SUMMARY

In various embodiments, a rowing machine may include includes a frame including a base for contact with a support surface, and a seat rail supported by the base. The rowing machine may also include a seat configured to reciprocate back and forth along the seat rail. The rowing machine may include at least one resistance mechanism, which in some examples is rotatably coupled to the frame. The rowing machine may further includes at least one handle operatively connected to the at least one resistance mechanism, and a paddle linkage assembly operatively connecting the at least one handle to the at least one resistance mechanism such that rearward movement of the handle is resisted by the at least one resistance mechanism.

In various embodiments, a rowing machine may include a frame, a handle pivotally coupled to the frame, and a flywheel rotatably coupled to the frame on a flywheel shaft and operatively connected to the handle to resist reward movement of the handle. The handle may be connected to the flywheel by a paddle linkage assembly, which includes first and second rocker links pivotally connected to the frame at two spaced apart locations on the frame, and a floating link connecting the first rocker link to the second rocker link such that the first and second rocker links, the floating link, and a virtual link defined between the two spaced apart locations define a four-bar linkage configured to translate the rearward movement of the handle to a rotational movement of a shaft operatively coupled to the rotatable flywheel to drive rotation of the flywheel.

This summary is neither intended nor should it be construed as being representative of the full extent and scope of the present disclosure. The present disclosure is set forth in various levels of detail in this application and no limitation as to the scope of the claimed subject matter is intended by either the inclusion or non-inclusion of elements, components, or the like in this summary.

BRIEF DESCRIPTION OF THE DRAWINGS

The description will be more fully understood with reference to the following figures in which components may not be drawn to scale, which are presented as various embodiments of the exercise machine described herein and should not be construed as a complete depiction of the scope of the exercise machine.

DETAILED DESCRIPTION

Figure 1:
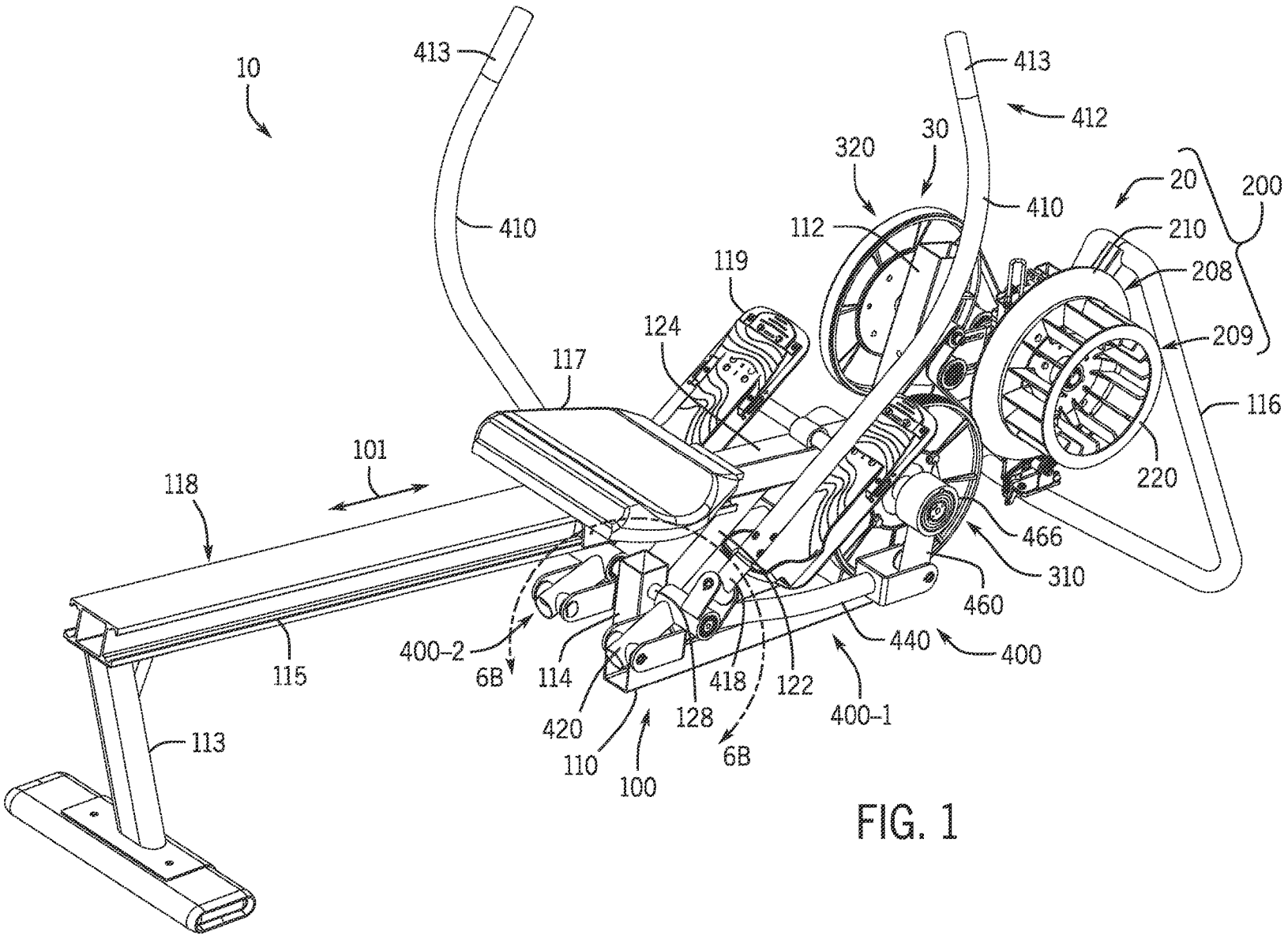
FIG. 1 is an isometric view of a rowing machine in accordance with some examples of the present disclosure.
Figure 2:
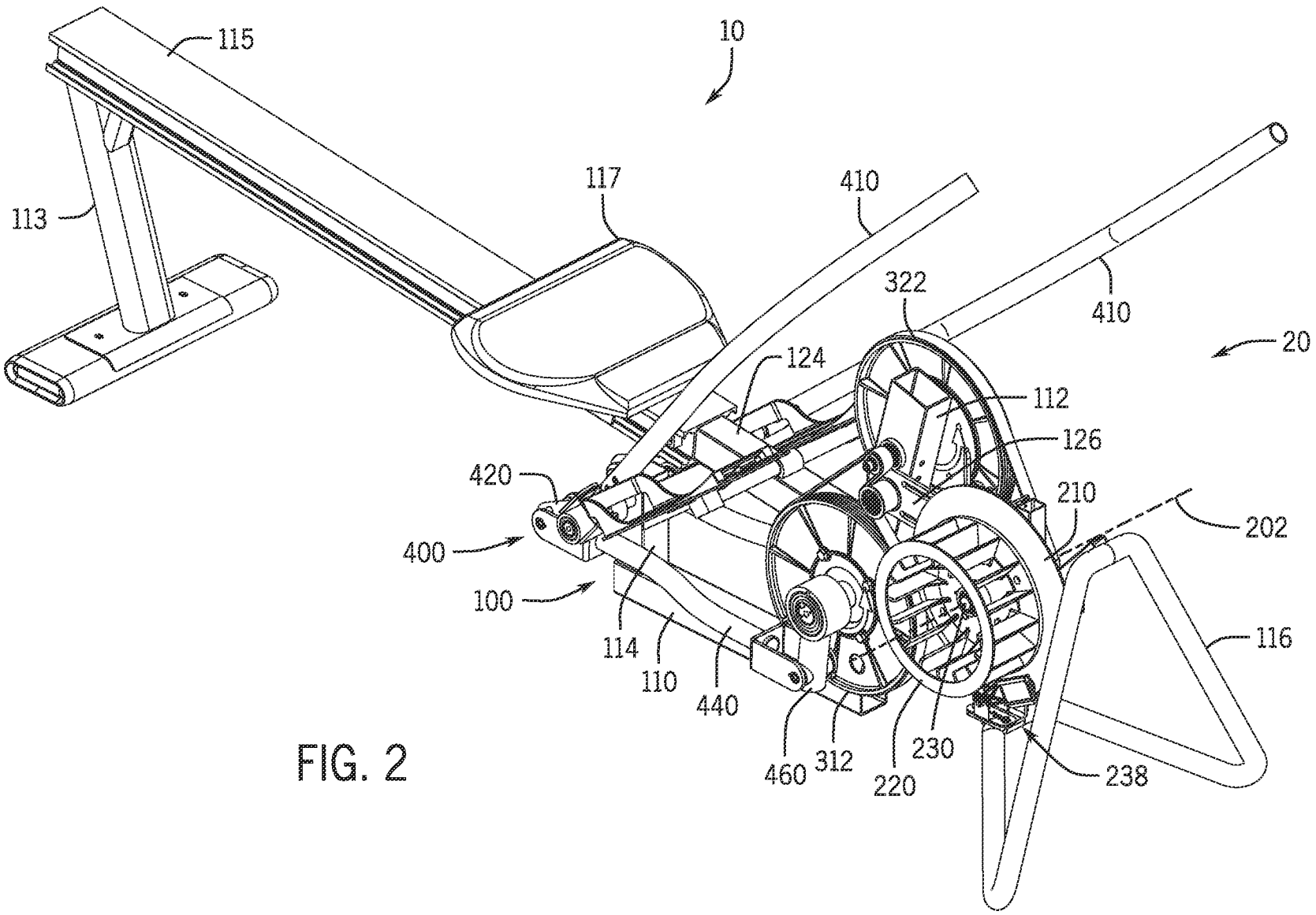
FIG. 2 is another isometric view of the rowing machine in FIG. 1.
Figure 3:
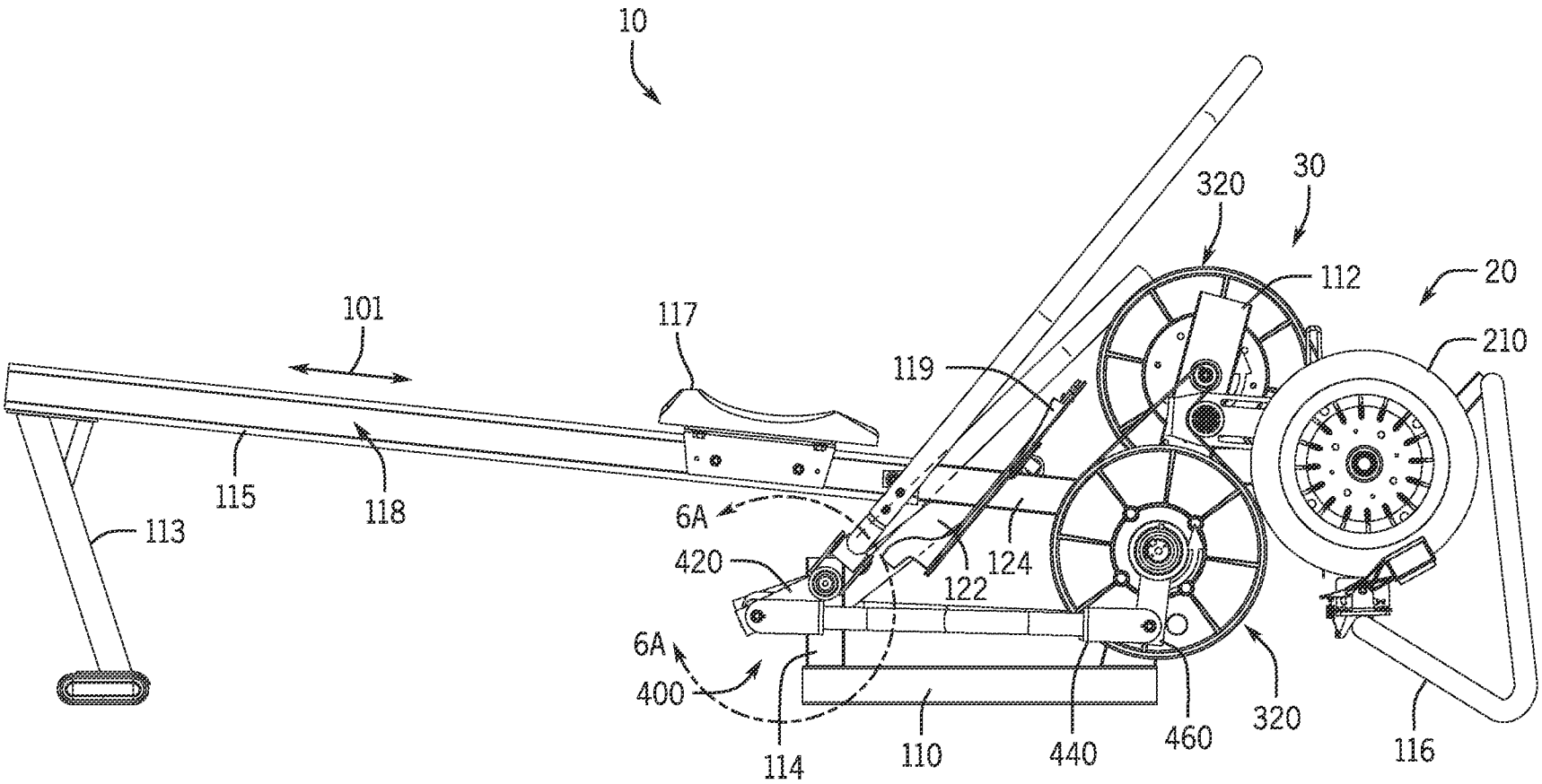
FIG. 3 is a right side view of the rowing machine in FIG. 1.

Described herein are embodiments of a rowing machine. A typical rowing machine includes a resistance mechanism typically connected via a chain, to a pull bar, and a seat which moves back and forth along a rail as the user pulls the bar aft against the resistance of the resistance mechanism. As previously noted, this configuration results in the user's hands moving only forward and backward along two generally parallel paths, which motion does not accurately simulate the motion, and thus muscle activation, during real-life rowing of a boat.

Boats are propelled by paddles or oars, each of which is essentially a lever held to the hull of the boat at a pin (i.e., the fulcrum). As the user pulls on the paddle, the load is transferred from the handle end to the blade, which in result cuts through the water and pushes the boat forward. The rowing stroke (i.e., the set of actions to propel the boat) includes a drive phase during which pressure is applied through the oars, and a recovery phase during which the oars are lifted out of the water and returned to the start position. As can be appreciated, the user's hands which grip the oar handles do not travel along a purely linear path but travel along an arc with respect to the fulcrum. For example, in sculling, the oar handles overlap at the midpoint of the drive, and again during the recovery. This type of action cannot be fully replicated with conventional rowing machines.

The rowing machine of the present disclosure is configured to more closely mimic the functionality of a boat, which motion has been found by the inventors to activate the body (e.g., muscle groups) in a manner more similar to a true rowing experience than may be currently possible with conventional rowers. The rowing machine employs rigid arm members, which essentially function as paddles or oars, that are operatively coupled to the frame such that the handles can move forward and backward as well as inward and outward with respect to the centerline of the machine to more closely mimic the motion of a rower's arms when rowing a boat. In examples herein, the relative position of the seat, paddle pivots, catch position and feet angles are selected to mimic the rigging set up of real-life boats so as to maximize the similarities with real-life boats and thus improve the user experience.

In examples herein, the handles, which the user grips to effect a rowing motion, are coupled to the input shaft of the rowing engine without the use of cables and pulleys, as is the case in conventional rowing machines, but using instead an appropriately configured linkage assembly. In some examples, each handle may be coupled to the rowing engine (e.g., to the input shaft) by a plurality of rigid links operatively connected to one another to form a kinematic chain, referred to herein as a paddle linkage or simply linkage, to transfer the power applied to the handles to the input shaft. By using rigid links, instead of cables and pulleys, movement of the handle(s) may be constrained along trajectories that more closely mimic the movement of oar handles of a real boat, for example arcuate trajectories of a free end of a lever about its fulcrum. The usage of rigid links in place of cables and pulleys may provide certain advantages over conventional rowers, such as enabling the rowing machine to more closely mimic the lever action of an oar when rowing a boat. Moreover, in the case of a two-paddle configuration, the individual sets of rigid links that simulate each of the right and left oars, may be configured to move and drive the input shaft independent of one another, thus allowing the respective handles to move in independent and different trajectories, unlike conventional rowers where the user pulls on the same bar with both hands and thus both of the user's hands travel in parallel following essentially the same trajectory.

The rowing machine may further include at least one handle, and in some embodiments a pair (left and right) handles, operatively connected to the at least one resistance mechanism 208, and a paddle linkage assembly operatively connecting the at least one handle to the at least one resistance mechanism such that rearward movement of the handle is resisted by the at least one resistance mechanism.

FIGS. 1-9 show views of a rowing machine 10. The rowing machine 10 includes a frame 100, a rowing engine 20, and a seat 117 which translates back and forth with respect to the forward end of the machine 10 during use of the machine 10. The rowing engine 20 in this example is positioned at the forward end of the machine 10. However, it will be appreciated that in other examples, the rowing engine 20 may be located elsewhere, such as at the rear end of the machine.

The frame 100 includes a base 110 for contact with a support surface (e.g., the ground) and first and second upright supports 112 and 114, respectively, rigidly connected to and extending upward from the base 110. The supports 112 and 114 may, but need not, extend vertically (i.e., at a 90 degree angle) from the base 110. The frame 100 also includes a seat rail 115 extending rearwardly from the first upright support 112. In some examples, the seat rail 115 may be coupled to and thus supported by one or both of the upright supports 112, 114. In some examples, the seat rail 115 may be coupled to only one of the supports or it may alternatively be supported by the base via a different support structure. In the illustrated example, the seat rail 115 is coupled to the first and second upright supports 112, 114 via the rail support 124, which is fixed to and extends rearwardly from the first upright support 112 and which is fixed to the second upright support 114 via the inclined brace 122.

The seat rail 115 may be fixed in relation to base 110, e.g., by being rigidly connected to one or both of the supports 112, 114. In some examples, the seat rail 115 may be pivotally coupled to the frame (e.g., pivotally coupled to the rail support 124) such that the incline of the seat rail 115 with respect to the support surface (e.g., ground) may be adjustable. Adjustability of the incline may be provided, for example, by a rear stabilizer 113 of adjustable height (e.g., increasing the height of the stabilizer 113 with respect to ground increases the incline to ground by lifting the rear end of the rail 115 and vice versa). In some examples, the seat rail angle with respect to ground may be varied from 0 degrees (i.e. level with ground) to up to about 15 degrees, or up to about 10 degrees, or up to about 6 degrees. In some examples, the incline may be fixed any angle within the range of 0 to about 15 degrees. As the incline increases the amount of force needed for the pull stroke increases thus increasing the difficulty of the workout. An incline-adjustable seat rail 115 thus provides an additional adjustment point (additional to varying the resistance, for example) to vary the difficulty of the workout.

The seat rail 115 is configured to movably support the seat 117 such that the seat reciprocates back and forth (as shown by arrow 101) along the seat rail 115 during use of the machine. In some examples, the seat 117 is slidably supported on the seat rail 115 by one or more rollers (not shown). In this illustrated example, the seat rail 115 includes a pair of tracks 118 disposed on the opposite sides of the seat rail 115. Each track 118 is configured to receive one or more rollers rotatably attached to the seat 117 (in this case, two rollers per track attached to the bottom side of the seat), thereby allowing the seat to glide along the rail via the rollers. In other examples, a different number of tracks (e.g., one track positioned on the top side of the rail) and/or rollers may be used.

The rowing engine 20 includes a resistance assembly 200. The resistance assembly 200 includes at least one resistance mechanism, such as a flywheel with a magnetic brake, a fan, or other suitable resistance mechanism, to resist the pulling action by the user. In the example in FIG. 1, the resistance assembly 200 includes two resistance mechanisms, namely a first resistance mechanism 208, which in this case is a flywheel 210 with a magnetic brake 238, and a second resistance mechanism 209, which in this case is a fan 220. The first and second resistance mechanisms 208, 209 are operatively connected to the handles of the rowing machine to resist the pulling action by the user. In this example, the flywheel 210 and fan 220 are rotatably coupled to the frame 100 via the same shaft, output shaft 230, and thus configured to rotate synchronously about a common rotation axis 202. The flywheel 210 and fan 220 are coupled to the frame 100 via the engine support 126 which extends forwardly from the first upright support 112. The rowing engine 20 is additionally supported at the front end of the machine 10 by a front stabilizer 116 joined to the engine support 126. In other examples the rowing machine 10 may use only a flywheel or only a fan, or an entirely different type (e.g., resilience-based) resistance mechanism or any combination thereof in any suitable arrangement to effect the desired resistance to rowing.

Figure 4:
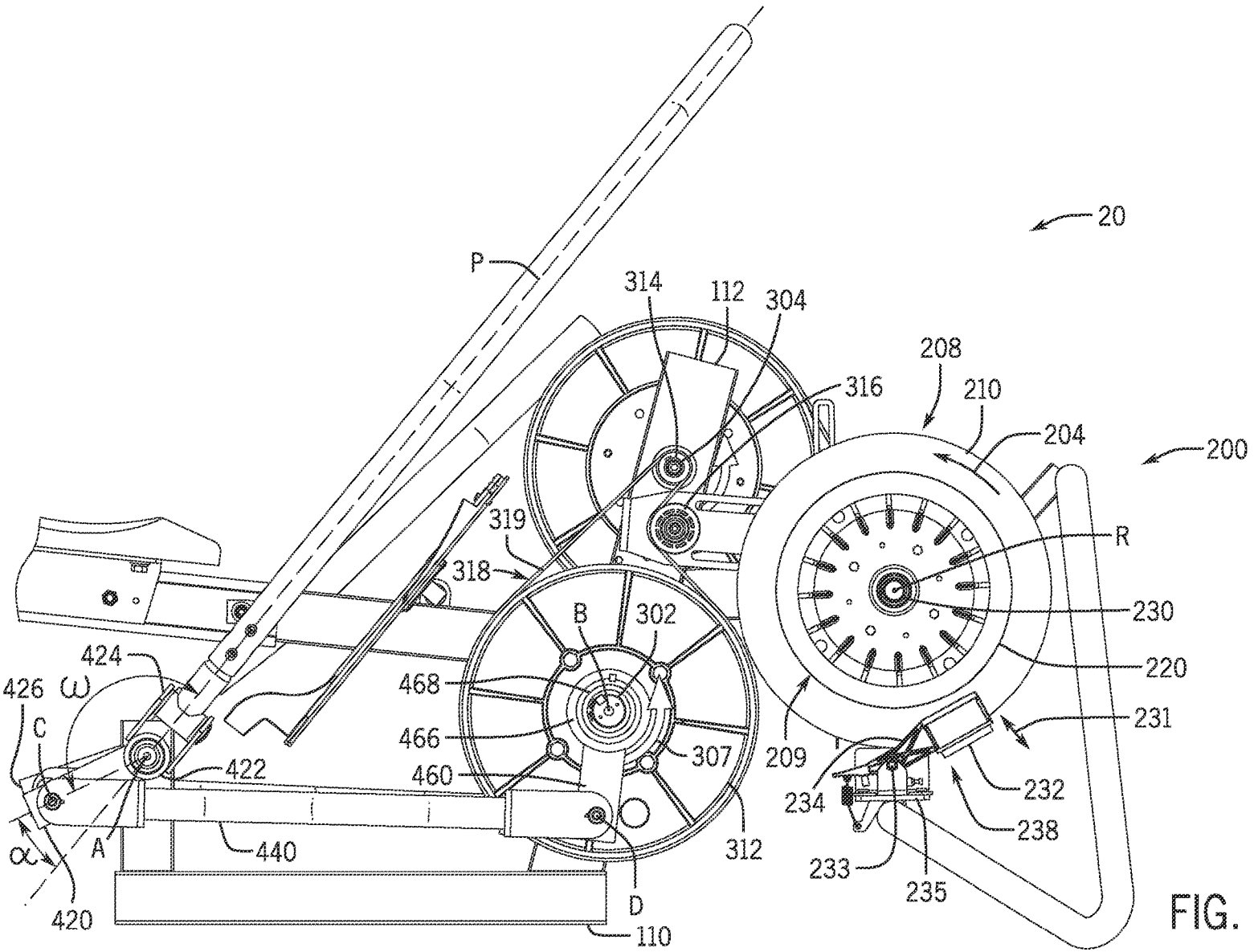
FIG. 4 is an enlarged right side view of the front portion of the rowing machine in FIG. 3.

As best seen in FIG. 4, the flywheel 210 is rotatably coupled to the frame 100 and operatively associated with a magnetic brake 238. The magnetic brake 238 may be implemented as an eddy current brake. For example, the flywheel 210 may be a disc made from ferromagnetic material and the magnetic brake 238 may include one or more magnets 232 operatively associated with the disc to dissipate the kinetic energy of the rotating disc. In preferred examples, the one or more magnets 232 are movable relative to the flywheel 210, e.g., along the radial direction 231, for varying the braking force applied to the flywheel 210. In some examples, a pair of magnets are disposed on opposite sides of the flywheel 210 and movable with respect to the flywheel, e.g., by pivotally coupling the magnet mount 234 which supports the magnets 232 to bracket 235, which is fixed to the frame, to define brake pivot 233. Positioning the magnets closer to the flywheel axis exposes the ferromagnetic disc to a larger amount of resistive force and thus applies a greater amount of braking force and conversely, pivoting the magnets away from the flywheel axis decreases the braking force on the flywheel and thus decreases the resistance to pulling action by the user. Any other suitable magnetic brake or a different type of brake (e.g., a friction brake) may be used in other examples.

The rowing machine 10 includes at least one handle 413, and in some embodiments a pair of handles (i.e. left and right handles) operatively connected to the at least one resistance mechanism 208 (e.g., flywheel 210) such that rearward movement of the handle is resisted by the at least one resistance mechanism. As described, a rowing machine according to the present disclosure may use a set of rigid links instead of cables to connect the handle to the rowing engine, which may provide certain advantages over cable-based designs. As shown in FIGS. 1-9, the rowing machine 10 includes a paddle linkage assembly 400, in this example including a first (or right) and second (or left) paddle linkages 400-1 and 400-2, respectively, that simulate the presence of pair of real paddles or oars and which are thus interchangeably referred to herein as paddles 400-1, 400-2. While the illustrated example shows a paddle linkage assembly 400 including both right and left paddles, it will be understood that in some embodiments, the rowing machine may include only one paddle (i.e. only a right paddle or only a left paddle) such as to simulate sweep rowing.

Figure 7A:
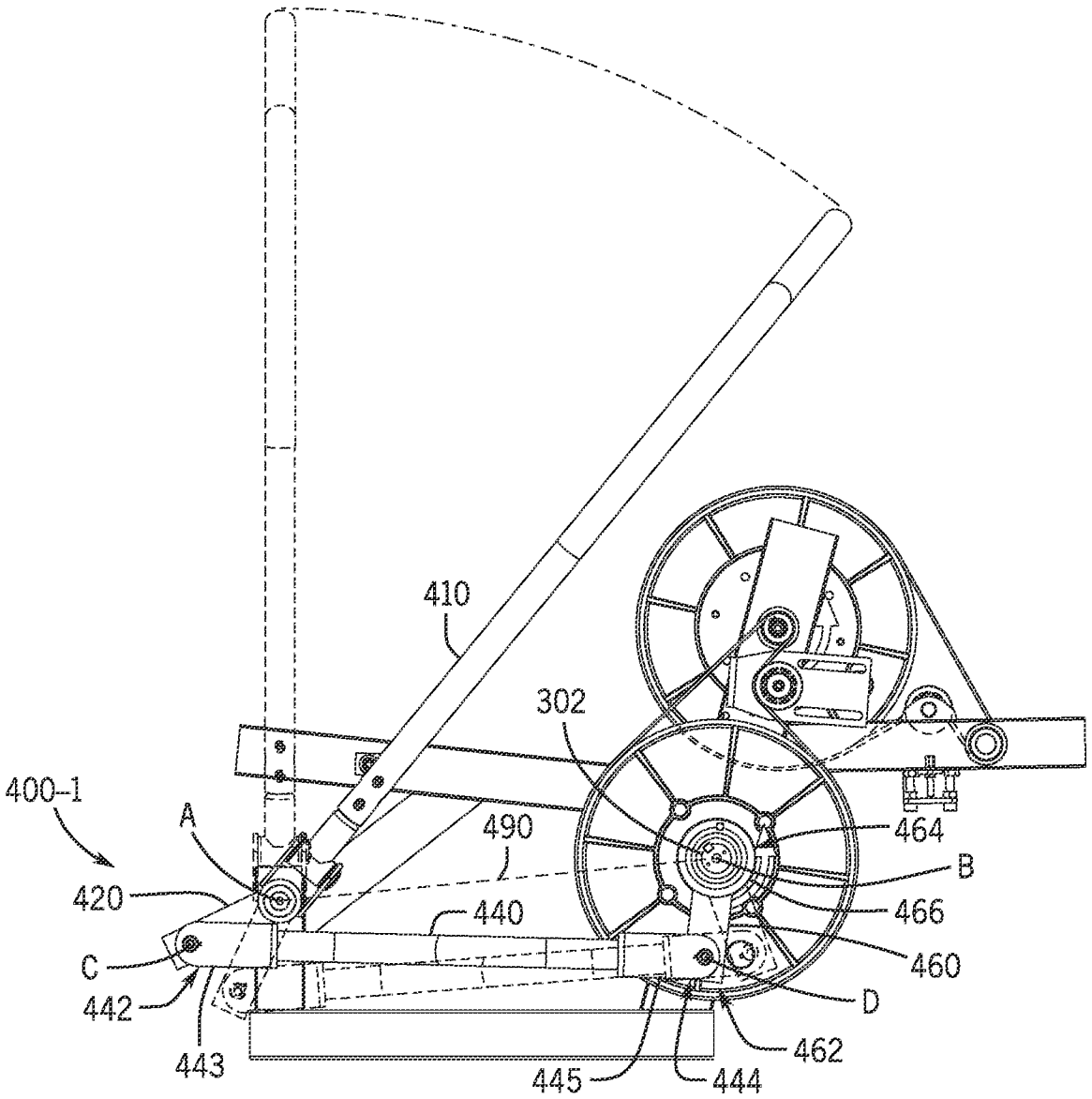
FIGS. 7A and 7B show partial side views of the paddle linkage of the machine in FIG. 1 at different positions along the paddle arc.
Figure 7B:
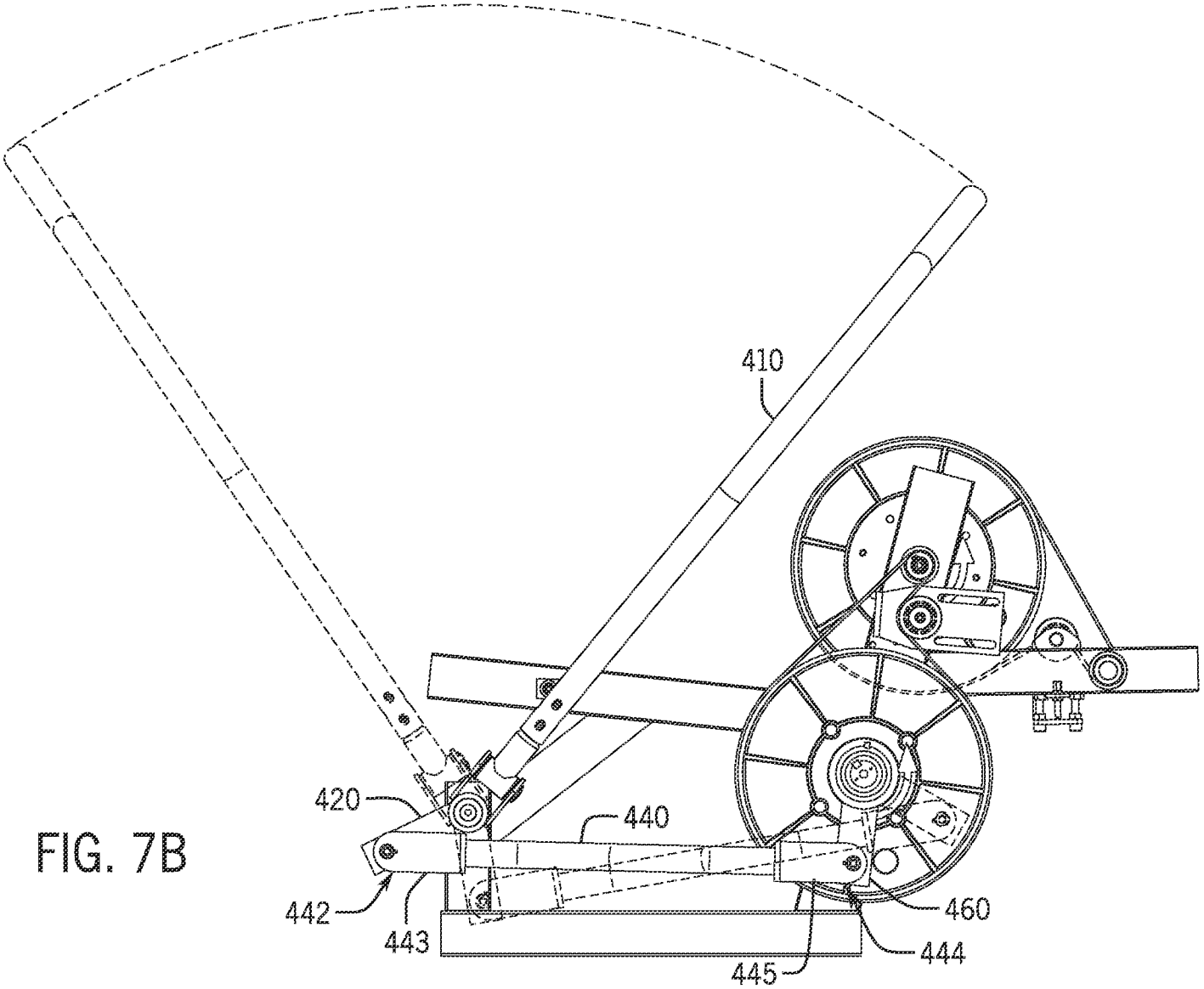
Figure 8A:
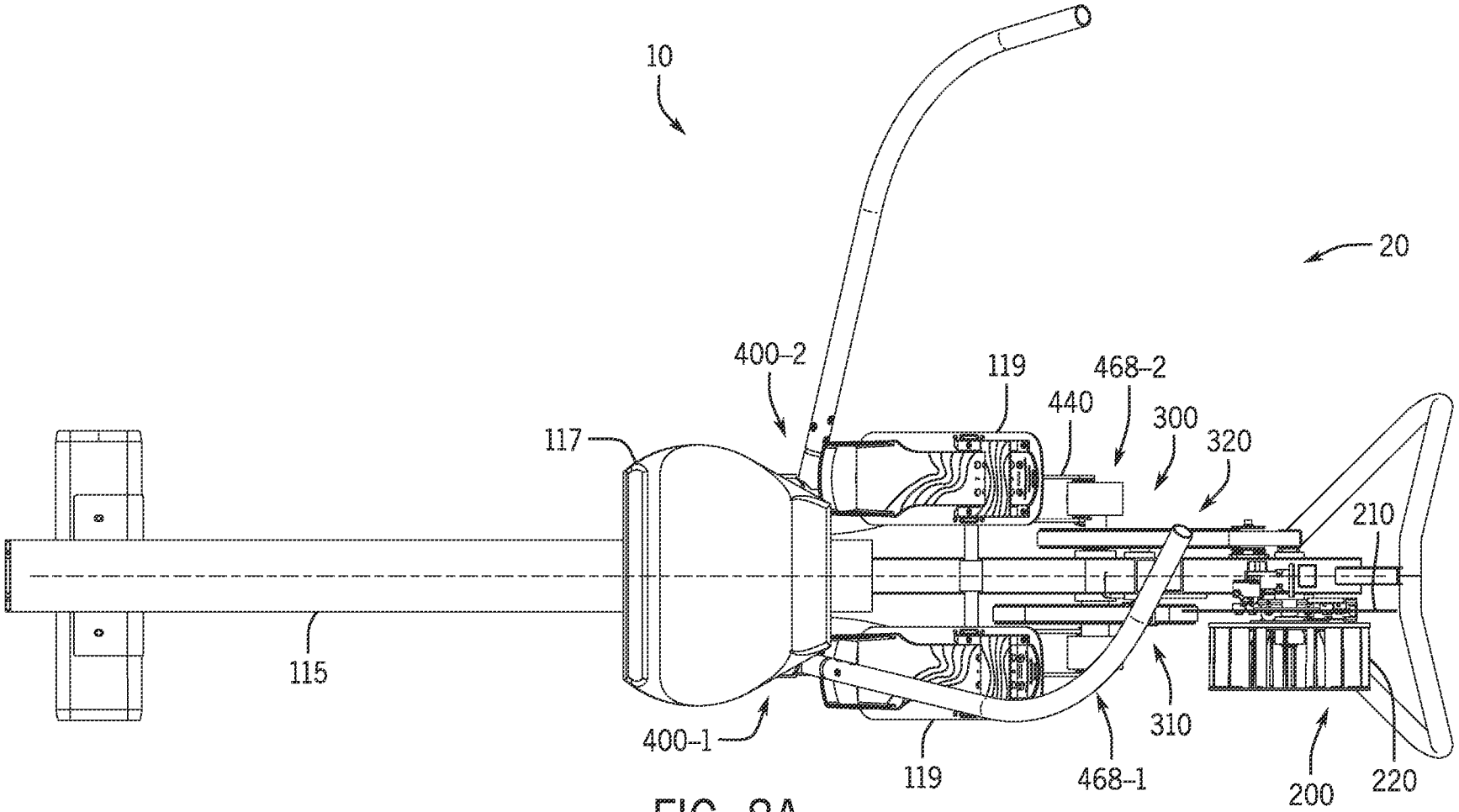
FIGS. 8A and 8B show top views of the machine in FIG. 1 showing the paddles at different positions with respect to the centerline of the rower.
Figure 8B:
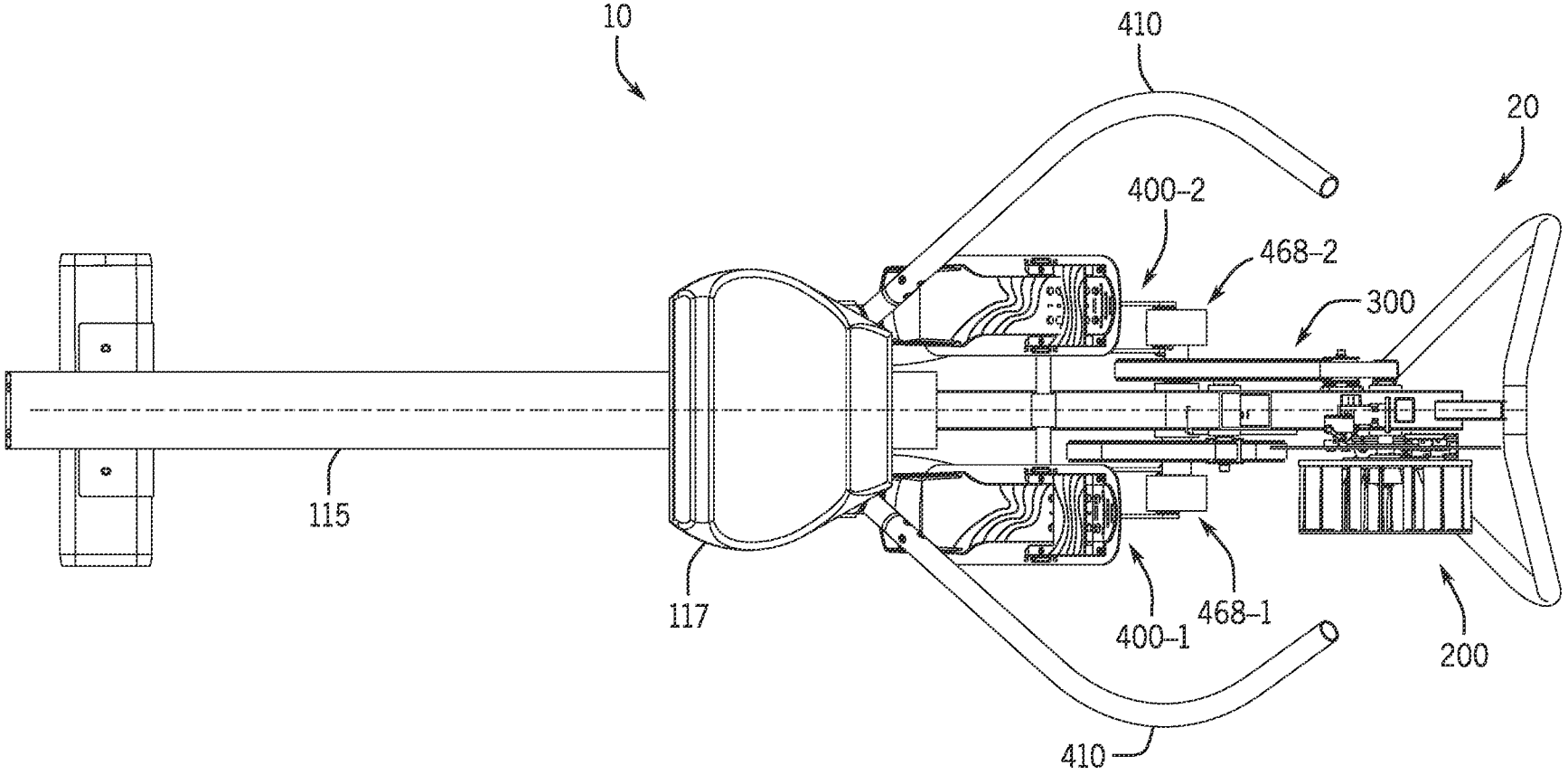
Figure 9:
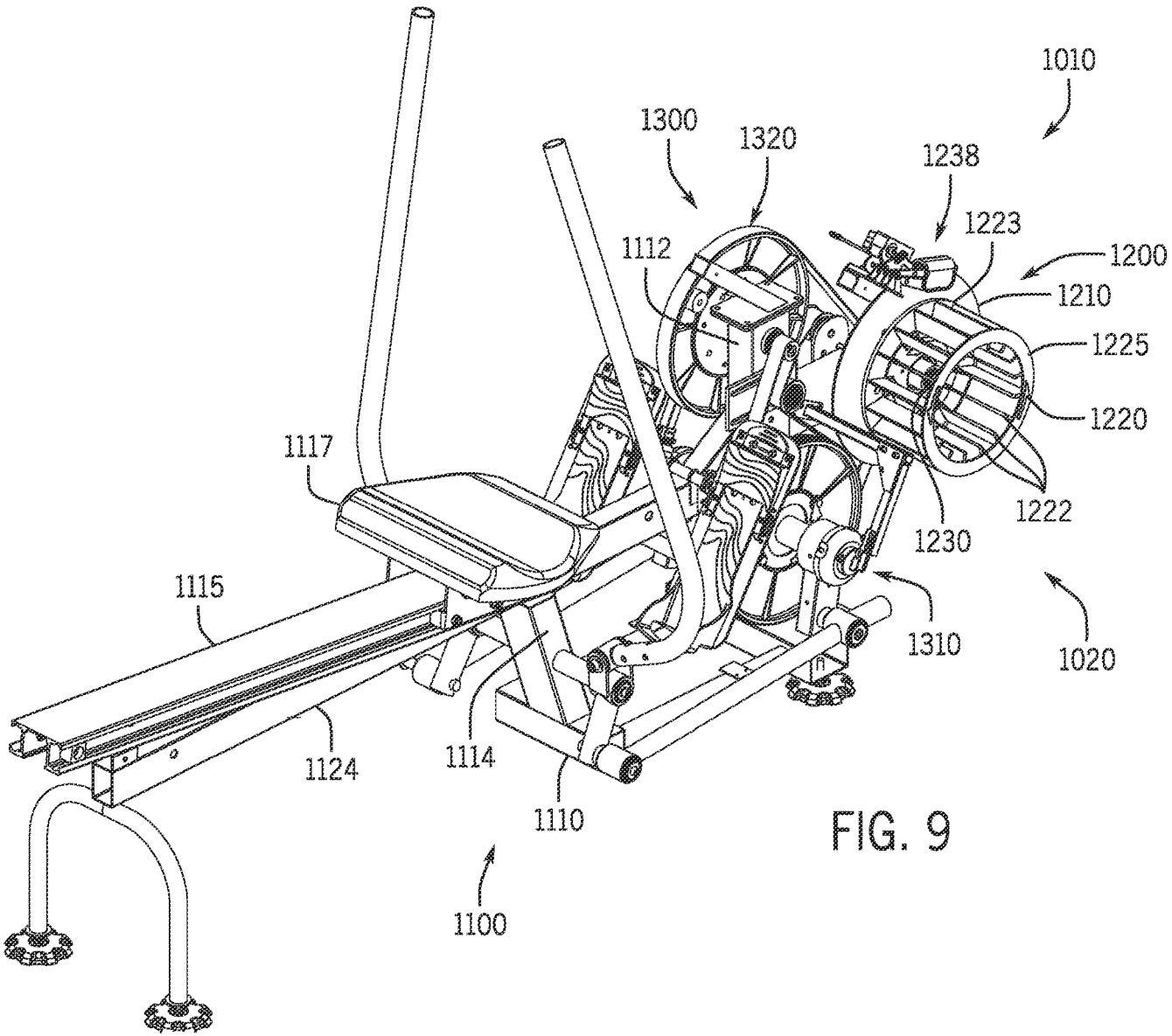
FIG. 9 is an isometric view of a rowing machine in accordance with further examples the present disclosure.

Referring further to FIGS. 7A and 7B, which show the right paddle 400-1 of the machine 10, components of the paddle linkage assembly 400 will be described. While details are described with reference to the right paddle, it will be understood that the left paddle includes the same components as the right paddle and is a mirror image thereof.

The paddle linkage assembly 400 includes a paddle link 420, a floating link 440 and a crank link 460 pivotally coupled to one another. In some examples, the pivotal connection between one or more of the links in the paddle linkage 400 may be implemented using lug and clevis type joints. In other examples, any other type of suitable pivot joint may be used to pivotally couple the links, for example by one link being pivotally coupled, via a bearing, to a post extending from the other link (e.g., as in the example in FIGS. 9-11).

The paddle link 420 and the crank link 460 are pivotally connected to the frame 100 at two spaced apart locations (i.e. pivot A and pivot B), such that the links 420 and 460, which act as a first and second rocker links, along with the floating link 440 and a fixed virtual link 490 between the two pivots points A and B form a four-bar linkage. The two pivot locations A and B are fixed to the frame. The fixed virtual link 490 corresponds to the ground link of the four-bar linkage.

In this example, the four-bar linkage is configured as a class II kinematic chain (or a non-Grashof four-bar linkage), which means that no individual link of the four-bar linkage is capable of a full revolution; rather the links are constrained to an oscillating motion. Using oscillating motion of both rockers eliminates the risk of full revolution binding and allows for a more compact design (e.g., a shorter floating link, thus shorter overall length of the machine since the paddle pivot location may be driven by ergonomics for simulating real boat riggings, and the front end of the machine may be thus be driven by the length of the floating link and/or a narrower overall size of the machine). However, in other examples, a Grashof four-bar linkage with, for example, the output rocker link configured to revolve fully around the input shaft, may also be used.

The paddle link 420, which is pivotally coupled to the frame at pivot A, is thus configured to pivot about a pivot axis A, and the crank link, which is pivotally connected to the frame at pivot B, is configured to pivot about pivot axis B. The pivot A is interchangeably referred to herein as the paddle pivot. The location of pivot A and various parameters of one or more of the links (e.g., length, shape, and sweep arc of the handle link) may be selected so as to mimic the motion of an oar. The pivot axis B is defined by and coincides with the axis of the input shaft 302.

Figure 6A:
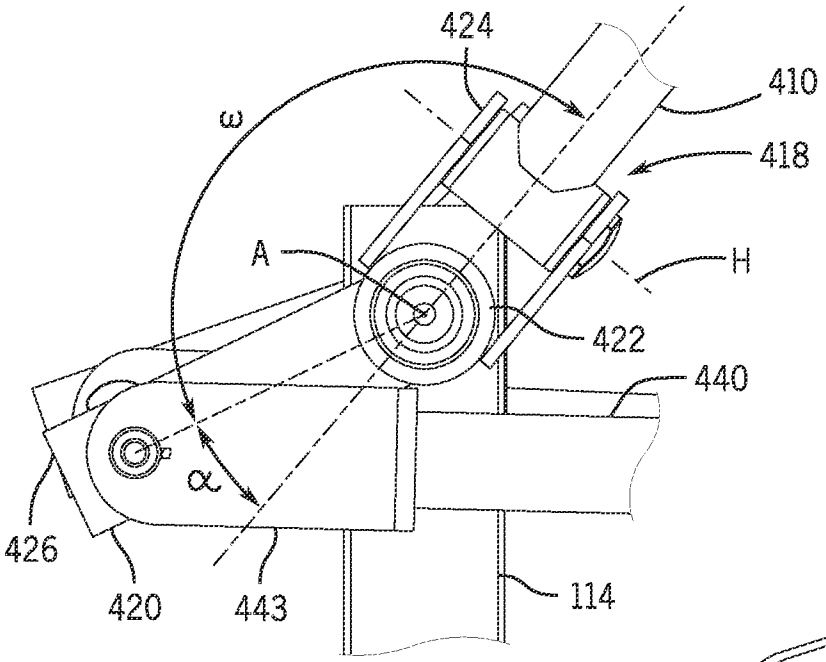
FIG. 6A is an enlarged side view of a paddle link of the rower of FIG. 1, which couples the paddle to the frame.
Figure 6B:
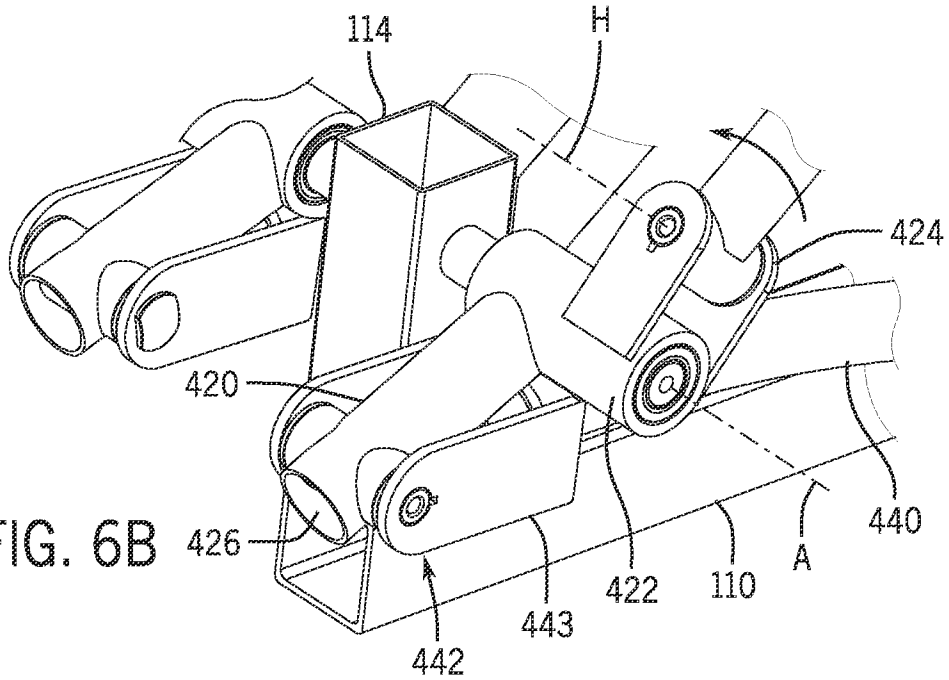
FIG. 6B is an isometric view of the paddle link in FIG. 6A.

As best seen in FIG. 6B, the paddle link 420 is a rigid member which is pivotally coupled to frame 100, and in this specific example, to the upright support 114. The paddle link 420 includes a tubular member 422, and first and second end portions 424, 426 fixed to and extending radially, in two different directions, from the tubular member 422. The first end portion 424 extends from one side of the tubular member 422 and is configured for pivotally coupling the handle link thereto. In the specific example, the first end portion 424 is implemented as a clevis (i.e. a u-shaped or forked connector). The second end portion 426 extends from an opposite side of the tubular member 422 and is configured as the lug of a clevis and lug type joint between the paddle link 420 and the floating link 440. The second end portion 426 defines the input rocker link of the four-bar linkage. The first and second end portions 424, 426 extend in different radial directions such that an angle $\omega$ is defined therebetween. In other words, the input rocker may be offset from the nominal paddle axis P in a direction opposite the four-bar linkage by an angle $\alpha$, which is less than 90 degrees, and preferably up to about 35 degrees. As the portions 424 and 426 are fixed to the tubular member 422, the angle $\omega$ (and correspondingly angle $\alpha$) remain fixed.

Figure 6C:
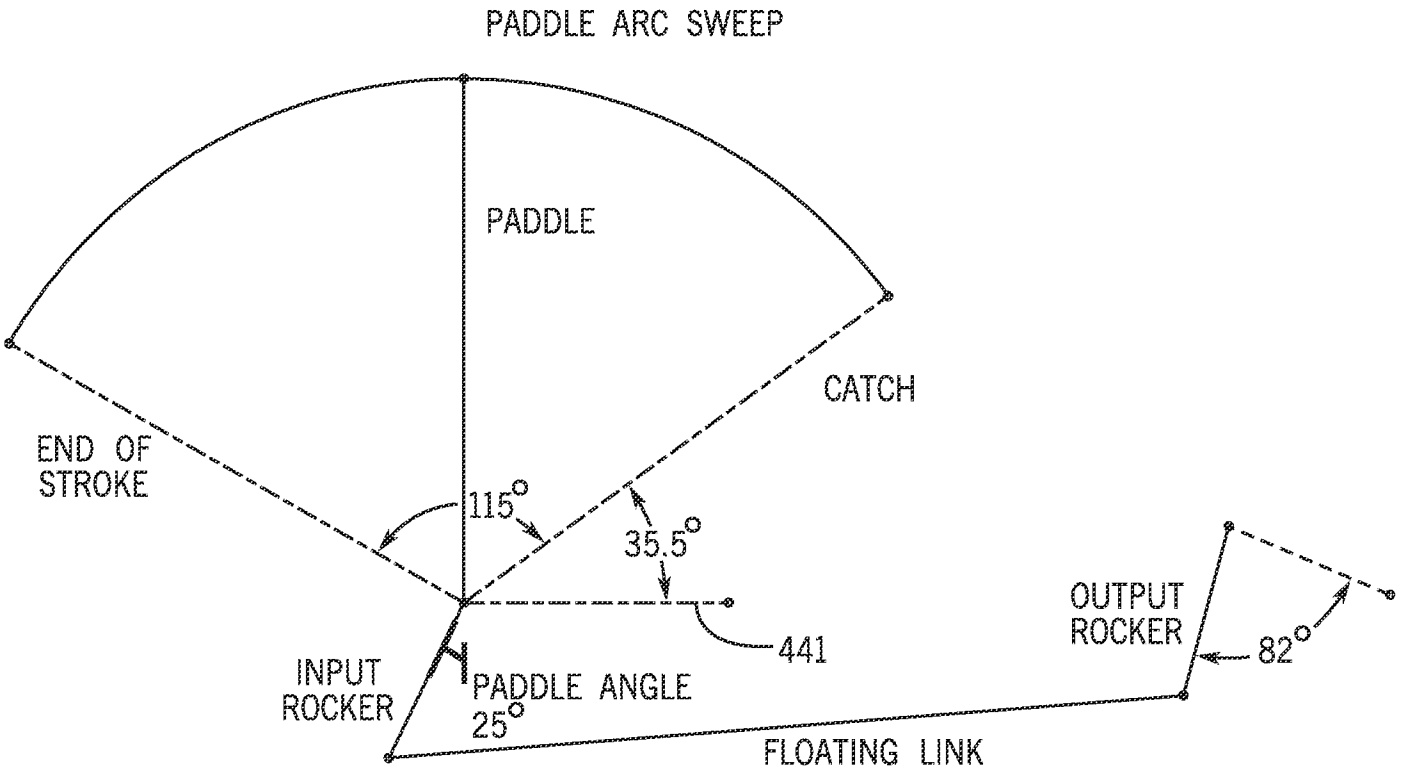
FIG. 6C shows a diagram of an example paddle arc during the driving phase (i.e., from catch to release) of the stroke.

Referring also to FIG. 6C, in one example arrangement, the offset angle between the floating link 440 and the input rocker (as defined, for example, by the second end portion 426) may be about 25 degrees from the paddle axis P allowing for a paddle arc sweep of about 115 degrees, which is an accurate representation of the arc sweep during the driving phase of rowing stroke (i.e. from catch to release).

In some embodiments, the input angle (i.e. movement of the input rocker by paddle motion driven by the user) may be limited thus limiting the range of motion of the output rocker. For example, as shown diagrammatically in FIG. 6C, the paddle arc sweep may be limited to about 115 degrees which may result in approximately 82 degrees of turn at the output rocker. The starting position of the paddle arc (e.g., with respect to a horizontal axis 441) may be selected such that the catch position more closely mimics real boat rigging. Also, the angle of the input rocker with respect to the paddle axis may be selected so as to prevent the output rocker from rotating to and beyond the horizontal position.

The paddle link 420 is pivotable about axis A which coincides with the centerline of the tubular member 422. The tubular member 422 is pivotally supported on a post 128 via a bearing. The paddle link 420 is pivotally connected, at pivot C, to one end of the floating link 440. The opposite end of the floating link 440 is pivotally connected, at pivot D, to the crank link 460, such that when the two rocker links (i.e, paddle link 420 and crank link 460) swing back and forth responsive to the sweeping motion by the user on the paddles, the floating link 440 reciprocates back and forth with its first and second ends pivoting about the pivots C and D, respectively. The floating link 440 is a rigid member pivotally coupled at its opposite ends 442, 444 to the paddle link 420 and the crank link 460, respectively, such that the floating link swings back and forth through an arcuate reciprocating motion as the user moves the handles. The floating link 440 includes, at each of its opposite ends 442, 444, a respective connector 443 and 445, which in this example is implemented as a U-shaped connector or clevis. In other examples, a different arrangement for the pivotal couplings may be used, for example by using lug connectors on the floating link and respective clevis connectors on the rocker links, or using a different type of pivotal joint.

The crank link 460 is a rigid member pivotally connected, at its first end 462, to the floating link 440, and pivotally connected, at its second end 464, to the upright support 112. The crank link 460 is configured to drive rotation of the input shaft 302, which is operatively coupled (directly or via one or more intermediate members) to a resistance mechanism (e.g., to flywheel 210). The first end 462 of the crank link 460 is pivotally received in the clevis connector 445 of the floating link and the second end 464 of the crank link 460 includes a collar 466 for coupling the crank link 460 to the input shaft 302 (also referred to as main shaft or drive shaft). The crank link 460 is coupled to the drive shaft such that torque is transmitted from the crank link 460 to the drive shaft 302 in one rotational direction, while allowing the crankshaft 302 to rotate freely in the opposite rotational direction. For example, the crank link 460 may be coupled to the shaft 302 via a one way (or clutch) bearing 468 provided between the collar 466 and the shaft 302.

The handle 413 is operatively connected, via the paddle linkage 400, to the rowing engine 20 such that rearward movement of the handle 413 is resisted by the at least one resistance mechanism (e.g., 208, 209) of the rowing engine 20. As illustrated, a handle link 410 connects the handle 413 to the four-bar linkage for providing input to the four-bar linkage. The handle link 410 is a rigid member (e.g., a tubular member), which may be curved along its length to more accurately mimic a real paddle while allowing for a compact form factor of the rowing machine 10. For example, the handle link 410 may include a first end portion 415 which is rigidly connected to and extends along a direction defined by the paddle mount 418, and a second or handle end portion 412, which supports the handle 413 and which is curved inward (i.e. toward the centerline of the machine) in relation to the first portion. The arrangement of the handle end portion 412 may thus resemble the arrangement of the inboard portion of an oar and thus more closely mimic real-life rowing than conventional rowers.

In some examples, the handles may be coupled to the four bar linkage via a coupling (see also close up view in FIGS. 6A and 6B) that allows the lower end portion of the handle link 410 to pivot about a first axis H to allow motion of the handles toward and away from the center of the machine. Furthermore, the coupling allows the handle link 410, by virtue of its connection to the paddle link 420, to pivot about a second axis A which allows motion of the handles back and forth, enabling each of the user's hands to traverse independent arcuate paths similar to the path that would be followed if handling real paddles/oars of a boat. The coupling may thus be seen to mimic or function as a universal joint in that it may allowing substantially free and independent movement of each handle with respect to one another and the frame. In this example, the two pivot axes H and A are inclined to one another, specifically they are perpendicular to one another. Furthermore, in this example, the two axes H and A do not intersect. The first axis H, which is defined by the line extending perpendicularly between the two sides of the forked connector 424, is offset or spaced apart from the pivot axis A, which coincides with the centerline of the tubular member 422. In other examples, different arrangements may be used, such as by inclining the two axes by a different angle with respect to one another or by arranging them so that they intersect. As illustrated, the handle link 410 is pivotally connected to the paddle link 420 via a paddle mount 418 which provides rotational freedom of the handle link 410 about axis 401. The paddle mount 418 is a rigid link formed by two tubular portions in a T-shaped configuration. One of the tubular portions is coupled to the handle link 410 and the other tubular portion is received in the forked connector 424 of the paddle link 420.

The rowing engine 20 includes a gearing assembly 300 for tailoring the balance between torque and speed. The gearing assembly 300 is configured to increase the rotational speed of the drive shaft driving the resistance mechanism. In some examples, the gearing assembly 300 is configured to gear up by a ratio of up to 1:100 (i.e. an increase in speed from the input shaft 302 to the output shaft 230 by up to 100 times). In some examples a larger gear (or speed) ratio may be used. While referring here to "gearing assembly" and "gear ratio" it will be understood that gearing may be achieved without the use of gears but with other suitable means such as by a belt-drive or chain-drive system using input and output belt-driven discs of different diameters. In other examples, the input and output discs may be wheels with sprockets such that a chain-driven gearing assembly, rather than a belt-driven assembly, may be used. Any combination of suitable components configured to modify (increase or decrease) the rotational speed between the input and output shafts may be used. In other examples, the rowing engine may not include a gearing assembly and the power from the user pulling on the handles may be transferred (directly or indirectly) at a 1:1 ratio to the resistance assembly 200. In some such examples, the output link of the paddle linkage may directly drive the flywheel shaft or the paddle linkage may drive a shaft which is coupled (e.g., via a belt, chain, or gears but without change in the gear ratio) to the flywheel shaft.

Figure 5:
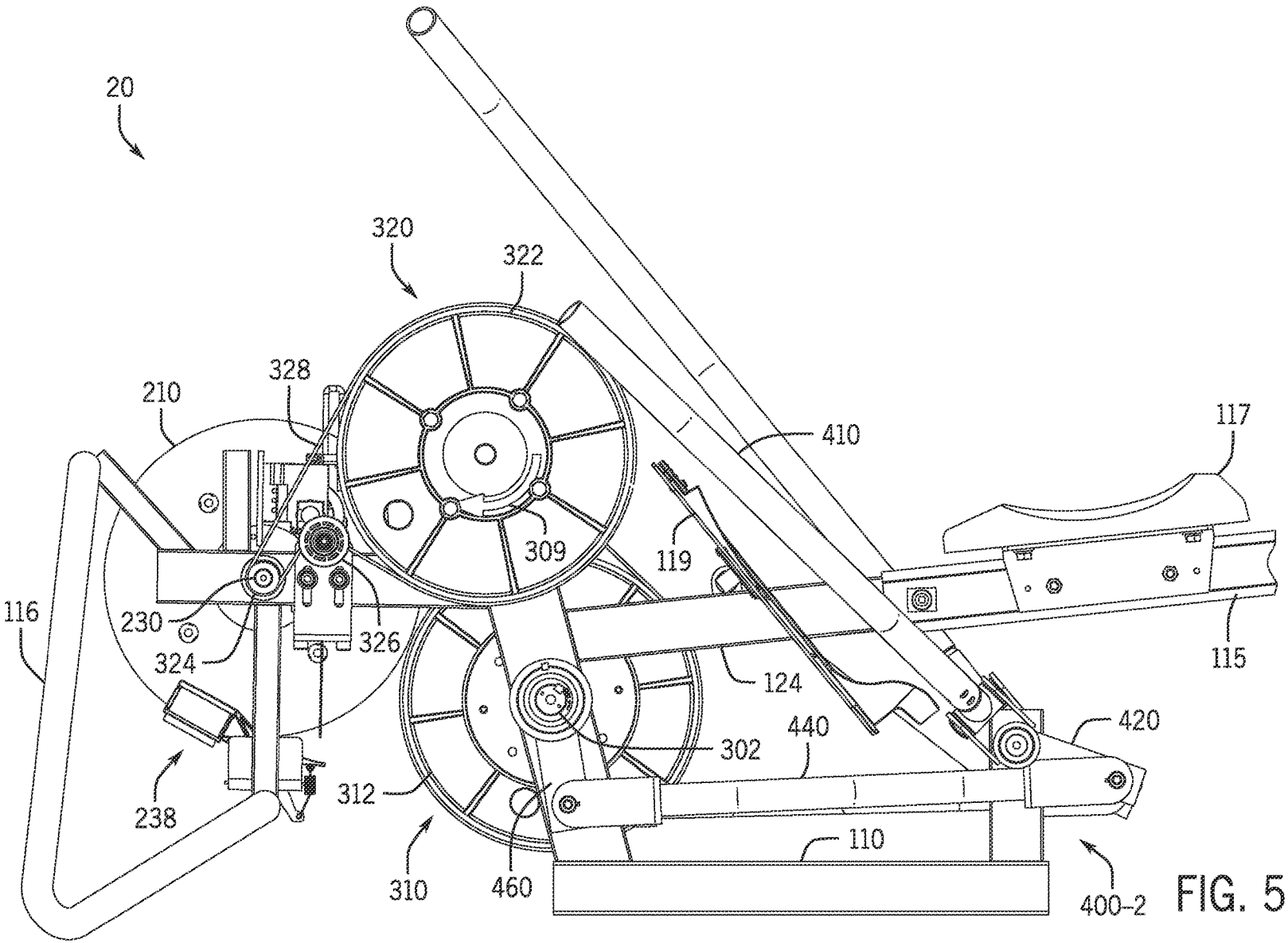
FIG. 5 is a left side view of the front portion of the machine shown in FIG. 4.

As described, the gearing assembly 300 is configured to increase the rotational speed between the input shaft 302, which is driven by the movement of the paddles, and the output shaft 230, which drives the resistance assembly (e.g., in this case, both the flywheel and fan, which are rotatable about the same axis R). The gearing assembly 300 in this example, as best seen in FIGS. 4 and 5, is implemented as a two-stage belt-drive system, which includes a first stage 310 and a second stage 320. The first stage 310 includes an input disc 312, an output disc 314, and an idler disc 316, each rotatably supported by the frame, and in this example rotatably coupled to the first upright support 112 via respective shafts. The input disc 312 is rotatably coupled via the input shaft 302 and the output disc 314 is rotatably coupled via the intermediate output shaft 304. The input disc 312 is driven to rotate in a first direction 307 by the forward rocking of the crank link 460. The input disc 312 is operatively coupled to the output disc 314 via a suitable power transmission member 318, in this case a belt 319. The idler disc 316 is operatively engaged with the power transmission member 318 to remove slack in the belt 319. The diameter of the input disc 312 is larger than the diameter of the output disc 314 thus increasing the rotational speed from input to output of the first stage.

The second stage 320 may be similarly arranged. For example, the second stage 320 of gearing assembly 300 includes an input disc 322 operatively coupled to an output disc 324 via a second suitable power transmission member 328 (e.g., a belt or a chain), and an idler disc 326 is positioned between the input and output discs 322, 324, respectively, to remove slack. The input disc 322 of the second stage (interchangeably referred to herein as second input disc) is rotatably supported on the frame by and is thus driven by the rotation of the intermediate output shaft 304. The output disc 324 of the second stage 320 (also referred to as second output disc 324) is rotatably supported on the frame by the same shaft as the flywheel 210 and fan 220 (see e.g., FIG. 5), i.e. output shaft 230. As illustrated, the shafts 302, 304 and 230 and correspondingly the input discs 312 and 322 and flywheel 210 all rotate in the same direction as shown by the arrows 307, 309, and 204.

The second stage 320 also includes a larger input disc as compared to the output disc, thereby further gearing up the rotational speed at the output shaft 230. In other examples, a different power transmission arrangement may be used, for example using a single stage or using a different number or arrangement of discs/gears in a given stage. In an example embodiment, each of the input discs (e.g., first input disc 312 and second input disc 322) may be about 280 mm in diameter while the output discs (e.g., first output disc 314 and second output disc 324) may be about 28 mm in diameter, providing an overall gear ratio of 100:1. Thus, for example, if a typical user's stroke rate is about 30 strokes per minute, the final speed at the output shaft of approximately 683 revolutions per minute can be achieved. The gearing assembly may be configured to provide a different gear ratio (or speed increase) in other examples, e.g., the speed increase in some examples may be in the range of 80:1 through 120:1.

The rowing machine 10 includes foot rests 119 (i.e., first or right foot rest and second or left foot rest) configured to support the user's feet during use of the machine. When using the rowing machine, the user's feet are placed against the foot rests 119 such that the user can push off the foot rests 119 during a rowing stroke (i.e. during the driving phase of the stroke). Each of the foot rests 119 may be operatively connected to the frame 100. For example, each foot rest 119 may be joined to the frame at a fixed angle with respect to ground. In some examples, the foot rests 119 may be adjustably connected to the frame to allow the user to change their incline with respect to ground.

Figure 10:
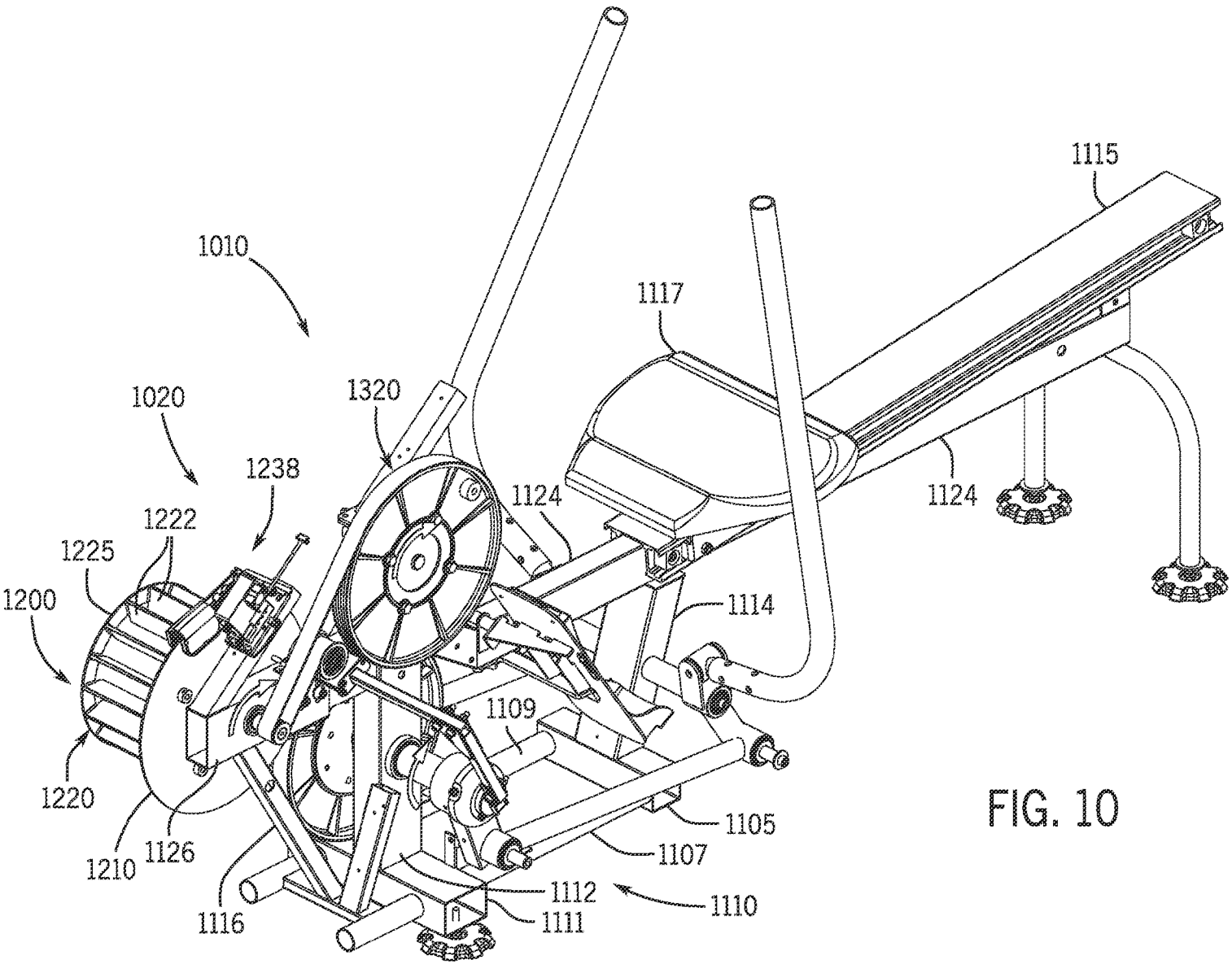
FIG. 10 is another isometric view of the rowing machine in FIG. 9.
Figure 11:
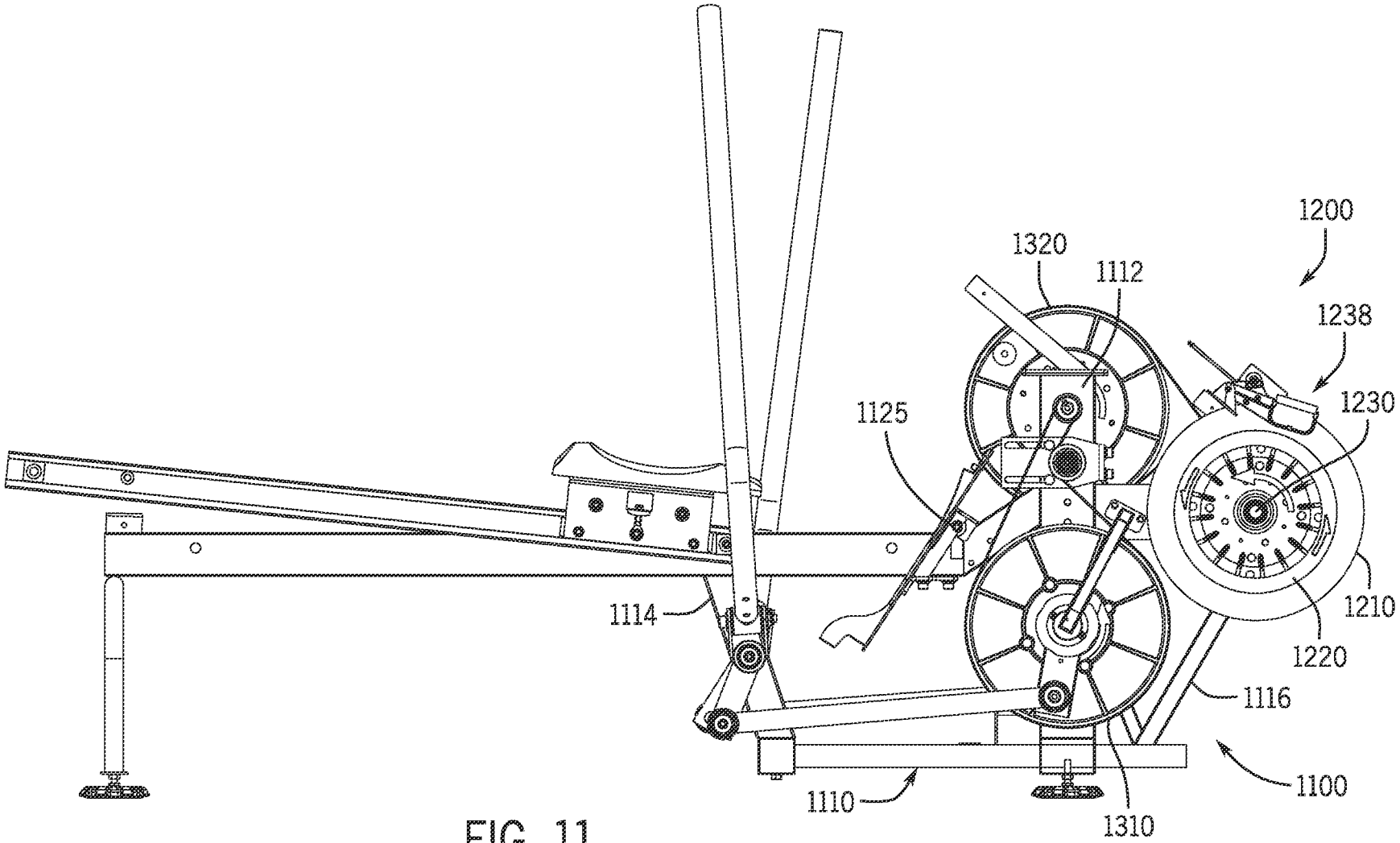
FIG. 11 is a side view of the rowing machine in FIG. 9.
Figure 12:
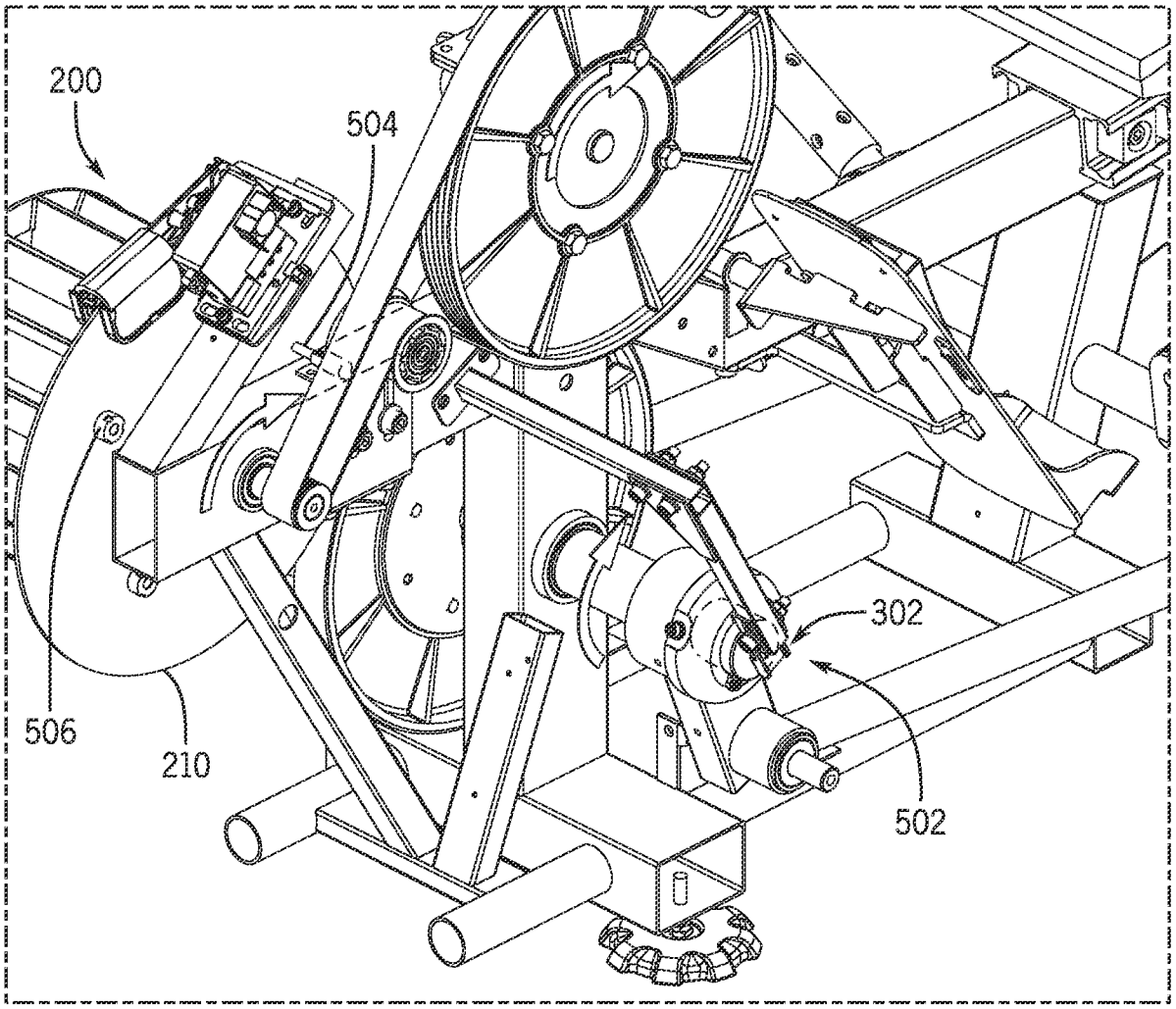
FIG. 12 shows a partial view of the rowing engine and placement of measurement devices in operative arrangement with one or more shafts of the rowing engine to monitor rotation of the shaft(s).

FIGS. 10-12 show a rowing machine 1010 in accordance with further examples of the present disclosure. The rowing machine 1010 may include one or more components similar to those described with reference to FIGS. 1-9. For example, rowing machine 1010 includes a frame 1100 and a rowing engine 1020. The frame 1100 includes a base 1110, which in this example is implemented as a box frame defined by front and rear transverse beams 1111 and 1105, and first and second longitudinal beams 1107 and 1109. The frame 1100 also includes a front support 1112 fixed to and extending upward (in this case perpendicularly to) the front transverse beam 1111 and a rear support 1114 fixed to and extending upward from the rear transverse beam 1105. A rail support 1124 is connected to both the front and rear supports 1112 and 1114 and supports the rail 1115 which is configured to slidably support the seat 1117 such that the seat 1117 can move back and forth along the rail 1115. In some examples, the seat 1117 may be removably coupled to the seat rail 1115. The seat rail 1115 is pivotally coupled to the rail support (e.g., at pivot 1125) such that the incline of the rail 1115 with respect to the base and thus with respect to ground could be adjusted.

The engine 1020 includes a resistance assembly 1200 and a transmission assembly 1300. The resistance assembly 1200 includes a magnetically resisted rotating disc 1210 and a fan 1220, both of which are rotatably supported on the same shaft 1230. The rotation of the shaft 1230 is resisted by a magnetic eddy current brake 1238 which applies a magnetic resistive force on the rotating disc 1210 to resist the rotation of the shaft 1230. At the same time, the fan 1220, which includes a plurality of paddles 1222 provided between inner and outer discs 1223 and 1225, respectively, also resist the rotation of the shaft 1230 independently of the resistance by the magnetic brake 1238. In some embodiments, the fan 1220 is coupled to the shaft 1230 via a one-way bearing such that the fan 1220 can continue to spin when there is no user input, thus allowing for the inertia of the fan to provide a feeling to the user as if gliding through water and also to allow the "catch" point of the rowing stroke to be felt at all resistances. The resistance assembly 1200 is supported on an engine support 1126, which is connected to and extends between the front support 1112 and a front stabilizer 1116.

The transmission assembly is implemented as a two-stage belt-drive assembly including a first stage 1310 and a second stage 1320. Each stage includes an input and an output member operatively connected to one another to change the rotational speed from input to output. The first and second stages are operatively connected to achieve an overall or combined change in the rotational speed. For example, the output member of the first stage may rotate on the same shaft as the input member of the second stage thus the output shaft of the first stage 1310 drives the input member of the second stage. In other examples a different arrangement may be used such as by using another belt or chain or one or more gears to transmit the rotation of the output shaft of the first stage to the input of the second stage.

In accordance with the principle of the present disclosure, the rowing machine 1010 utilizes a plurality of rigid links, rather than cables and pulleys, to connect the handles to the rowing engine 1020 for transferring the power from the user thereto. The relationships between the seat 1117, paddle pivots, the catch position, and feet angles are selected to mimic boat rigging setups to maximize similarities to a real boat. For example, the paddle pivots may be arranged at a location aft of the foot rests which may provide a boat compatible location during row (in recovery and initial pull).

Figure 14:
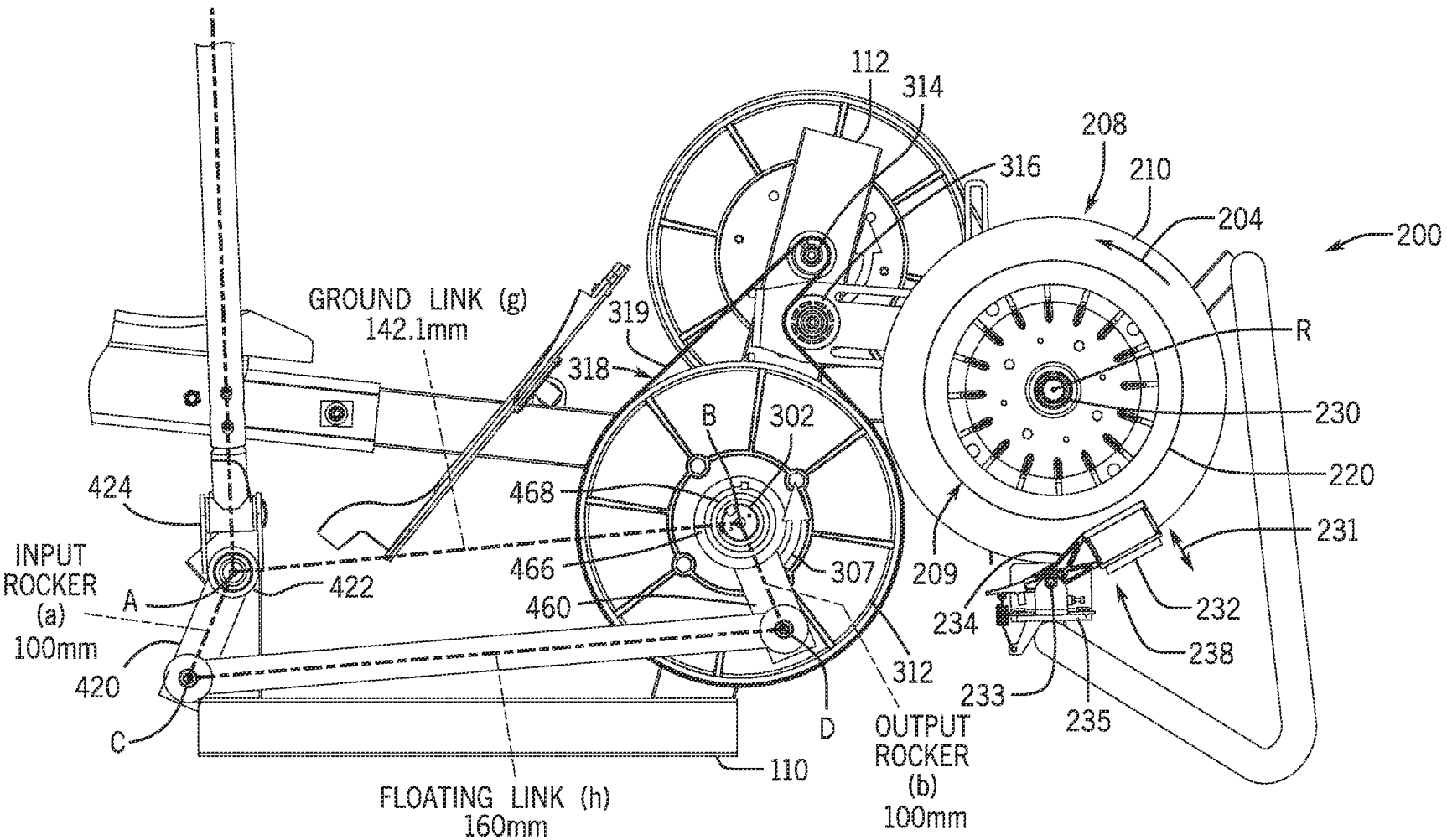
FIG. 14 shows a rowing machine according to further examples of the present disclosure.

In some examples, the rowing machine may include at least one measurement apparatus operatively associated with one or more moving components of the rowing machine (e.g., the crank shaft, the flywheel shaft, or both, or with any of the links) so as to monitor the movement (e.g., rotation) thereof. In some examples, paddle locations may be monitored throughout the entire stroke, which can allow for the visualization of the user's action/muscle activation and/or for coaching of rowing technique. In one example, monitoring of motion may be achieved via magnetic potentiometers 502 operatively arranged (e.g., on each of the left and right sides) with respect to the main shaft, as shown for example in FIG. 12. In further examples, the resistance disc and/or fan rotations may be monitored using a reed switch 504 and a magnet 506 to measure power. For example as shown in FIG. 14, one or more magnets 506 may be disposed on the flywheel 210 at a radial position such that when the flywheel rotates, the magnet 506 will pass within a close enough proximity of a reed switch 504 to cause, by magnetic force an electrical contact or other sensor in the reed switch to close, thereby signaling a revolution of the flywheel. Other types and arrangements of measurement devices may be used. For example, Hall effect, inductive, capacitive, photoelectric, mechanical, and/or ultrasonic sensors can be used in place of, or in addition to, a magnet 506 and a reed switch 504. Such sensors can also be disposed on or in relation to the input disc 312, the input disc 322, the output disc 314, and/or the output disc 324.

Figure 13:
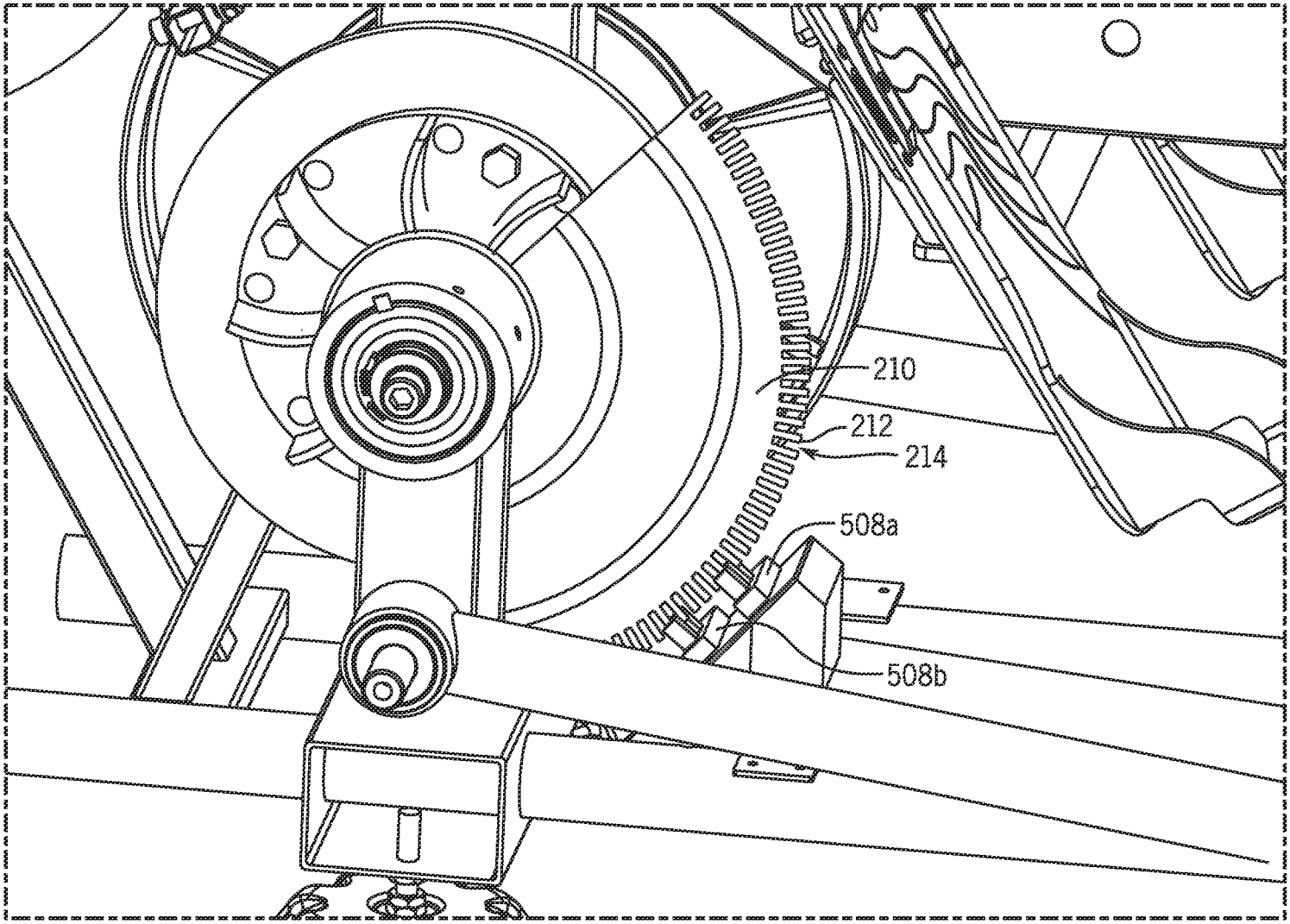
FIG. 13 shows an enlarged view of a resistance mechanism as driven by a paddle linkage assembly and placement of a measurement device in operative arrangement with the resistance mechanism for monitoring paddle locations throughout the stroke.

In further examples, the resistance disk shaft 230 may be equipped with optical sensors 508*a*, 508*b*. The optical sensors 508*a*, 508*b* can each have a light emitter disposed on one side of the resistance disc 210, and a detector disposed on the other side of the resistance disc, opposite the emitter, such that the detector can detect the presence or absence of light emitted by the emitter. The resistance disc 210 can be a notched disk (see e.g., FIG. 13), or be operatively coupled with such a notched disk, the notched disk having a plurality of sensor flags 212 with gaps 214 disposed between the flags 212. The flags 212 and gaps 214 can be arranged such that as the resistance disc 210 spins, the flags 212 and gaps alternately block and pass light emitted from the emitter of the optical sensors 508*a*, 508*b* to the respective detectors in the optical sensors 580*a*, 580*b*. Thus the optical sensors 508*a*, 508*b* can measure the rotational speed of the resistance disc 210. Using two or more sensors, the direction of the disc 210 can be monitored as well. For example, one sensor 508*a*, 508*b* monitors clockwise rotation and the other sensor 508*a*, 508*b* monitors counter clockwise rotation, which can then be used to calculate parameters of the movement of the paddles (e.g., direction of paddles).

FIG. 14 shows a partial view of another rowing machine according to the present disclosure. The rowing machine in FIG. 14 includes a rowing engine located at the front end of the machine and a linkage assembly connecting the handles to the rowing engine. The linkage assembly includes two sets of links, each simulating one of the left and right paddles of a boat. Each set of links is configured as a four-bar linkage including an input rocker and an output rocker (each approximately 100 mm in length, in this example), a floating link (of approximately 460 mm, in this example) and a ground link (of approximately 440 mm, in this example). Input is provided to the four-bar linkage via a corresponding paddle which is mounted to the input rocker such that the paddle is movable back and forth and toward and away from center during use of the machine. Also shown in FIG. 14 is a transmission assembly which includes a chain-driven first transmission stage 310 and a belt-driven second transmission stage 320.

The two fundamental reference points in the anatomy of a rowing stroke are the catch where the oar blade is placed in the water and the extraction (also known as the finish) where the oar blade is removed from the water. After the blade is placed in the water at the catch, the rower applies pressure to the oar levering the boat forward which is called the drive phase of the stroke. Once the rower extracts the oar from the water, the recovery phase begins, setting up the rowers body for the next stroke. In a boat, gearing, similar to bicycle gearing, is used to adjust the power needed to operate the oars or paddles. Light or low gears provide an easy exertion level—that is, one stroke of the paddle is easy to do, requires less power, but does not take the user far. Heavy or high gears, are easy at high speeds, one stroke of the paddles take more effort but moves the user much farther. Gearing in boat is achieved by adjusting the location of the pin or fulcrum. A lightly geared boat requires more strokes to move the same distance as a heavily geared boat but the strokes for the heavily geared boat are harder to make. The relationship between the seat, paddle pivots, catch position and feet angles mimic boat rigging setups to maximize similarities to boats. Paddle pivots are located midway along the seat rail which provides a boat compatible location during row (in recovery and initial pull).

Figure 15:
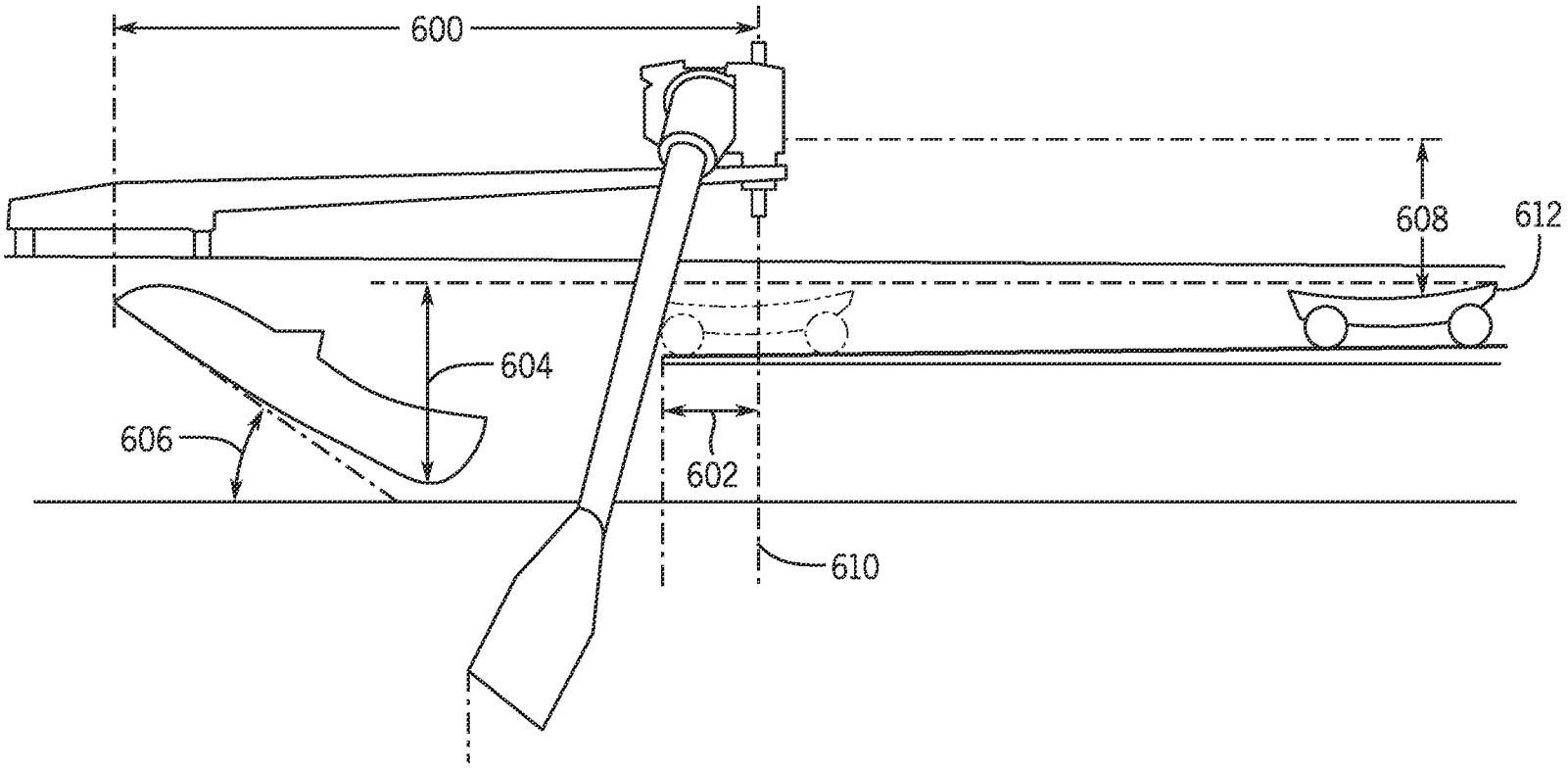
FIG. 15 shows configuration parameters associated with boat rigging.

FIG. 15 illustrates variables or parameters relevant to boat rigging. With reference to FIG. 15, a rowing machine may be configured with a stretcher angle 606 within the range of 35-50 degrees, and more preferably within the range of 40-44 degrees. A stretcher angle 606 on the high end may be used to allow as much power from the push off while maintaining near vertical shins at catch for a wide demographic of users. In some examples, the rowing machine may be configured for a heel depth 604 in the range of 12-22 cm, or more preferably in the range of 15-19 cm. A heel depth 604 of 17 cm may be used in some examples, as the near neutral position for neither high nor low geared boats. A stretcher position 600 within the range of 50-69 cm or preferably in the range of 55-65 cm may be used. In some examples, a shorter than average stretcher position 600 (e.g., around 50 cm) may be used which may provide a lighter gearing feeling. The stretcher position 600 may also affect the overall side of the machine, thus a shorter stretcher position 600 may provide a more compact design. A suitable range for the work through 602 for embodiments herein may be anywhere within the range of 12-22 cm or preferably within the range of 14-20 cm. A work through 602 on the higher end may be selected to allow for taller users to utilize the rowing machine and/or to provide a heavier gearing feel, or the work through 602 value may be adjusted toward the lower end to achieve the opposite result. Other relevant parameters to boat rigging can include the gate height 608 above the seat 612, and the position of the center line of the pin 610. Other configuration parameters of the rowing machine that may affect the gearing feeling of the rowing machine may include the seat rail angle, which as previously discussed, may be configured to be at an incline and/or adjustable to an incline of at least up to 6 degrees to provide for a stronger workout thus mimicking higher gearing. The paddle pivots may be positioned close to the centerline of the seat when in the catch position thus more closely mimicking the loading on the body in real-life rowing/boating.

All relative and directional references (including: upper, lower, upward, downward, left, right, leftward, rightward, top, bottom, side, above, below, front, middle, back, vertical, horizontal, and so forth) are given by way of example to aid the reader's understanding of the particular embodiments described herein. They should not be read to be requirements or limitations, particularly as to the position, orientation, or use unless specifically set forth in the claims. Connection references (e.g., attached, coupled, connected, joined, and the like) are to be construed broadly and may include intermediate members between a connection of elements and relative movement between elements. As such, connection references do not necessarily infer that two elements are directly connected and in fixed relation to each other, unless specifically set forth in the claims.

Those skilled in the art will appreciate that the presently disclosed embodiments teach by way of example and not by limitation. Therefore, the matter contained in the above description or shown in the accompanying drawings should be interpreted as illustrative and not in a limiting sense. The following claims are intended to cover all generic and specific features described herein, as well as all statements of the scope of the present method and system, which, as a matter of language, might be said to fall there between.

What is claimed is:

1. A stationary exercise machine comprising:

a frame;

a shaft rotatably coupled to the frame and configured to be driven by user force;

a resistance mechanism rotatably coupled to the frame to resist rotation of the shaft;

a driven member operatively coupled to the frame to pivot about a first pivot having a first pivot axis responsive to the user force; and a four-bar linkage operatively connecting the driven member to the shaft for transmitting the user force from the driven member to the shaft, the four-bar linkage comprising:

a first link pivotally coupled to the frame at the first pivot;

a second link pivotally coupled to the frame at a second pivot having a second pivot axis parallel to and spaced apart from the first pivot axis whereby a virtual link is defined between the first and second pivot axes; and a third link having one end operatively connected to an end to the first link opposite the first pivot, wherein an opposite end of the third link is operatively connected to an end to the second link opposite the second pivot whereby the first link, the second link, the third link, and the virtual link form the four-bar linkage.

2. The stationary exercise machine of claim 1, further comprising a handle at a terminal end of the driven member.

3. The stationary exercise machine of claim 1, wherein a distance between the first and second pivots is fixed whereby the virtual link is a fixed virtual link.

4. The stationary exercise machine of claim 3, wherein the driven member is further configured to pivot relative to the first link about a third axis non-parallel to the first pivot axis.

5. The stationary exercise machine of claim 1, wherein the four-bar linkage is configured such that none of the first link, second link, floating link and virtual fixed link are capable of a full revolution.

6. The stationary exercise machine of claim 1, further comprising a seat configured to move along a rail supported by the frame.

7. The stationary exercise machine of claim 1, wherein the shaft is spaced apart from and parallel to the second pivot axis.

8. The stationary exercise machine of claim 7, wherein the shaft is elevationally spaced apart from the second pivot axis.

9. The stationary exercise machine of claim 8, wherein the shaft is above the second pivot axis.

10. The stationary exercise machine of claim 1, wherein the resistance mechanism comprises a flywheel rotatably supported on the frame by the shaft, wherein the shaft is spaced apart and parallel to a transmission shaft, wherein the transmission shaft spaced apart and parallel to the second pivot axis and configured to rotate in response to a pivotal movement of the second link, and wherein the transmission shaft is operatively coupled to the shaft to transmit any rotation of the transmission shaft to the shaft.

11. The stationary exercise machine of claim 10, further comprising a first disk coupled to a same side of the frame as the flywheel and configured to rotate about the first pivot axis, and a second disk coupled to an opposite side of the frame via the transmission shaft.

12. The rowing machine of claim 1, wherein the four-bar linkage is a first four-bar linkage disposed on one side of the frame, the exercise machine further comprising a second four-bar linkage on an opposite side of the frame operatively coupled to apply user force to the shaft, independently of the first four-bar linkage, via a second driven member.

13. A stationary exercise machine comprising:

a frame comprising a rail;

a seat configured to move back and forth along the rail;

a rigid member pivotally coupled to the frame to pivot about a first pivot axis;

a rowing engine comprising:

an input shaft;

a flywheel rotatably about an output shaft and configured to provide resistance to pivotal movement of the rigid member; and a two-stage gearing assembly configured to increase a rotational speed from the input shaft to the output shaft; and a transmission assembly comprising a linkage that connects the rigid member to the input shaft, the transmission assembly being configured to convert the pivotal movement of the rigid member to rotational movement of the input shaft, and wherein the linkage comprises a four-bar linkage wherein each link of the four-bar linkage is incapable of a full revolution.

14. The stationary exercise machine of claim 13, wherein the four-bar linkage is one of a pair of four-bar linkages, each positioned on opposite side of the frame and configured to move independent of one another.

15. The stationary exercise machine of claim 13, wherein the two-stage gearing assembly comprises a first disk rotating in synchrony with the input shaft and second disk rotating in synchrony with a second shaft operatively coupled to the first disk for transmitting rotation of the first disk to the second shaft, and where the second disk is operatively coupled to the output shaft to transmit rotation of the second disk to the output shaft.

16. The stationary exercise machine of claim 15, wherein the second shaft operatively coupled to the first disk via a first flexible transmission member and the second disk is operatively coupled to the output shaft via a second flexible transmission member.

17. The stationary exercise machine of claim 15, wherein the first and second disks are located on opposite sides of the frame.

18. The stationary exercise machine of claim 15, wherein the second shaft is located elevationally higher than the input shaft.

19. The stationary exercise machine of claim 15, wherein the output shaft is located elevationally between the input shaft and the second shaft.

* * * * *